US008597593B2

(12) United States Patent
Boehm et al.

(10) Patent No.: US 8,597,593 B2
(45) **Date of Patent: *Dec. 3, 2013**

(54) BOTTLE TOP DISPENSER FOR HANDLING LIQUIDS

(75) Inventors: Dieter Boehm, Sinntal-Sterbfritz (DE); Wolfgang Ettig, Homburg (DE); Peter Mahler, Kreuzwertheim (DE); Juergen Schraut, Rettersheim (DE); Roland Wohner, Wertheim (DE)

(73) Assignee: Brand GmbH + Co KG, Wertheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/405,477

(22) Filed: Feb. 27, 2012

(65) Prior Publication Data

US 2012/0183453 A1 Jul. 19, 2012

Related U.S. Application Data

(63) Continuation-in-part of application No. 12/518,199, filed as application No. PCT/EP2007/010580 on Dec. 6, 2007, now Pat. No. 8,142,738.

(30) Foreign Application Priority Data

Dec. 7, 2006 (DE) ..... 20 2006 018 526 U
Dec. 7, 2006 (DE) ..... 20 2006 018 527 U

(51) Int. Cl.
*B01L 3/00* (2006.01)

(52) U.S. Cl.
USPC ..... 422/501

(58) Field of Classification Search
USPC ..... 422/501
See application file for complete search history.

(56) References Cited

U.S. PATENT DOCUMENTS 3,805,998 A 4/1974 Croslin
4,995,532 A * 2/1991 Knodel ..... 222/43

(Continued)

FOREIGN PATENT DOCUMENTS

DE 31 43 600 A1 5/1983
DE 34 17 016 C1 12/1985

(Continued)

OTHER PUBLICATIONS

English Machine Translation of DE 3534550.*

(Continued)

*Primary Examiner* — Christine T Mui
(74) *Attorney, Agent, or Firm* — Roberts Mlotkowski Safran & Cole, P.C.; David S. Safran

(57) ABSTRACT

A bottle top dispenser for handling liquids having a piston-cylinder arrangement in an outside housing. At least one actuating button (49) that can be pressed downwards is arranged on the upper side of the outside housing. The outside housing (2) can be provided with ventilation openings (48) that can be hidden beneath the actuating button (49). The bottle arrangement is also characterized by a specific arrangement of a sensor system (65) in relation to a measuring strip (64) on a piston rod (28). The path measuring signal can be evaluated by means of a magnetoresistive sensor system, especially such a system based on the AMR effect. The arrangement of the measuring strip (64) in relation to the longitudinal central axis of the piston rod (28) is of considerable importance.

42 Claims, 12 Drawing Sheets

(56) References Cited

U.S. PATENT DOCUMENTS

| | | | |
|---|---|---|---|
| 5,862,958 | A | 1/1999 | Edwards et al. |
| 7,146,867 | B2 | 12/2006 | Jagdhuber |
| 7,244,397 | B2 | 7/2007 | Bigus |
| 2005/0194407 | A1 | 9/2005 | Bach |
| 2006/0143482 | A1 | 6/2006 | LaChapelle et al. |

FOREIGN PATENT DOCUMENTS

| | | | | |
|---|---|---|---|---|
| DE | 35 01 909 | C1 | 7/1986 | |
| DE | 35 16 596 | A1 | 10/1986 | |
| DE | 35 34 550 | A1 | 10/1986 | |
| DE | 3534550 | * | 10/1986 | ..... G01F 11/04 |
| EP | 0 086 912 | A1 | 8/1983 | |
| EP | 0 250 095 | A2 | 12/1987 | |
| EP | 0 559 223 | A1 | 9/1993 | |

OTHER PUBLICATIONS

English Machine Translation of DE 3534550, 1996, obtained on May 5, 2011.*

* cited by examiner

BOTTLE TOP DISPENSER FOR HANDLING LIQUIDS

CROSS REFERENCE TO RELATED APPLICATION

This application is a continuation-in-part of U.S. patent application Ser. No. 12/518,199, now U.S. Pat. No. 8,142,738.

BACKGROUND OF THE INVENTION

1. Field of Invention

The invention relates to a bottle top dispenser for handling liquids. In these appliances, it is important to have an exact metering and conveyance of liquids out of a storage bottle or another storage container. Exact metering taking place when a volume of liquid is taken up from the supply bottle or the like into the appliance and/or when a volume of liquid is dispensed from the appliance outward into a container.

2. Description of Related Art

Bottle top dispensors of the type in question are used comprehensively in chemistry, biology and pharmacy in the laboratory and in production.

The term "liquid" designates, in the present context, liquids, such as are used comprehensively in chemistry, biology, pharmacy, etc., in the laboratory and in production, in particular, liquids with a relative viscosity of up to about 300 (viscosity in relation to the viscosity of water under normal conditions). Therefore, the liquids range from very thin flowing liquids to slightly thick-flowing ones.

A manually operable burette serves, during titration, for determining the unknown quantity of a dissolved substance from the consumption of a reagent liquid of known concentration. In order to ensure expedient and efficient analysis work, a burette must satisfy the requirements of a rapid and accurate dispensing and indication of the specific liquid quantity. In this case, high demands are made as to the precision of the dispensing of liquid and as to operator safety (General Catalogue 600 "Laborgeräte von Brand" ["Brand Laboratory Appliances"] of BRAND GMBH+CO KG 09/01, No. 9963 00, "Burette Digital III", pages 27 to 34).

Comparable demands are also found in bottle top dispenser dispensers, particularly in those with a digital indication of the desired metering volume (DE-A-35 16 596; General Catalogue 600 "Laborgeräte von Brand" ["Brand Laboratory Appliances"] of BRAND GMBH+CO KG 09/01, No. 9963 00, "Dispensette", pages 9 to 18).

Hereafter, the bottle top dispenser is described in its operating position, that is to say in its position fastened on a storage bottle and oriented essentially vertically.

The valve block usually has located in it a suction intake valve which makes it possible to suck in liquid from the storage bottle by means of a suction intake pipe. A discharge line with a discharge valve located in it extends approximately horizontally from the valve block. Since the discharge line projects approximately horizontally from the valve block and often also carries an additional changeover valve, this is the side from which an operator works with the bottle top dispenser. This side is therefore designated hereafter as the "front side" or as the "front." The opposite side is the "back side" or "rear." In a bottle top dispenser, an indicator with corresponding operating elements is usually located in front.

The known bottle top dispenser for handling liquids, from which the invention proceeds (see the General Catalogue 600 "Burette Digital III", as given above), is distinguished in that the cylinder/piston arrangement is overmounted from above by an outer housing closed on top. This outer housing moves upward, with respect to the cylinder, together with the piston rod. In order to implement this, the cylinder has located on it a vertically running rack, with which meshes a pinion on a driveshaft which is mounted in the outer housing. The piston drive of this bottle top dispenser is designed for manual actuation, and therefore the driveshaft carries a manual actuation knob there at each of the two ends outside the outer housing.

The precise advantage of this bottle top dispenser is that the outer housing is closed around the cylinder/piston arrangement. However, this, is at the expense of the movement of the overall outer housing, together with all the subassemblies arranged in it. Particularly in the position in which the outer housing is moved fully upward, such an arrangement of the bottle top dispenser and storage bottle has a considerable tendency to tilt.

A similar design with a corresponding tendency to tilt is also found in other bottle top dispensers (German Patent Applications DE-A-35 16 596 and DE-A-35 34 550).

Another solution is found in a bottle top dispenser in the form of a piston burette with digital indication, in which a housing receiving the piston drive, the indicator, a sensor arrangement and control electronics is in a fixed invariable relative position with respect to the valve block (German Patent DE-C-35 01 909). Here, however, the outer housing is not closed, but, instead, the piston rod passes through the housing upward from below, even when the piston is in the lowest position in the cylinder. When the piston is moved up, the piston rod emerges from the housing on top. In this case, by means of an upwardly connected concertina, the ingress of dirt and dust via the passage orifice for the piston rod into the housing is prevented.

In the bottle top dispenser explained above, admittedly, the tendency to tilt is somewhat lower than in the bottle top dispenser from which the invention proceeds, because the outer housing is not displaced overall with respect to the valve block. However, this entails the structural disadvantage of the outer housing being open on top.

In all bottle top dispensers of the type in question, actuating buttons are located on the front side of the outer housing. An actuation of the actuating buttons in this case makes it necessary to prop up the outer housing, in any event if a tilting of the arrangement of the bottle top dispenser and storage bottle is to be reliably prevented. This is important particularly in the case of storage bottles of small volume.

Many influences in terms of design and of handling are important for the accuracy of a bottle top dispenser of the type in question. What is important, inter alia, is the stick/slip effect, that is to say the overcoming of the static friction of the piston in the cylinder at the transition to sliding friction during displacement. Many structural factors of the bottle top dispenser are involved here. Operator friendliness and operator safety are in this case essential boundary conditions.

The above-explained structural features of the known bottle top dispensers are relevant for operator friendliness and operator safety.

Furthermore, for accuracy and operator safety, the boundary conditions, under which bottle top dispensers of the type in question are often used, have to be taken into account.

As has already been referred to, it is advantageous to design the bottle top dispenser so as to be largely chemical-resistant. However, this does not only involve the surfaces coming into contact with the liquid. In fact, caustic or otherwise harmful liquids, of course, also generate corresponding vapors which may present problems in the inner space of the outer housing of the bottle top dispenser according to the invention.

In the abovementioned bottle top dispenser with a concertina, there is the particular problem that the vapors emanating from the wetting of the inner wall of the cylinder cannot escape. The space surrounding the piston rod is displaced by the piston during the suction intake operation. This atmosphere, in this case, escapes past the sensor system and coats it. The permanent action of these vapors on components of this type in a closed and non-actuated housing quickly leads to considerable operating faults.

The teaching of the present invention, then, is based on the problem of specifying a bottle top dispenser for handling liquids which achieves particularly high operator friendliness and operator safety.

SUMMARY OF THE INVENTION

The present invention achieves a solution to the above-indicated problem by means of a bottle top dispenser having the sensor arrangement is arranged in a reception pocket closed completely with respect to the measuring strip.

The solution involves a shifting of at least one actuating button from the indicator on the front side of the outer housing onto the top side of the latter. However, depending on space and requirements, also two or even more actuating buttons may be arranged on the top side of the outer housing.

As a prerequisite, the outer housing is closed on the top side and surrounds the cylinder/piston arrangement from above. The solution according to the invention makes use of these facts, known per se for decades, to achieve the possibility of an optimized actuation of the bottle top dispenser. An actuating button, which is often used when working with the bottle top dispenser, can be actuated here by pressure from above. Quick and fault-free actuation is thereby possible, without a serious tilting movement being exerted on the bottle top dispenser and on the storage bottle located beneath it. Contrary to the actuating buttons arranged on the front side of the outer housing, therefore, there is no need to prop up the outer housing.

Finally, a large-area actuating button on the top side of the outer housing may be used in a double function, for concealing ventilation orifices at this point.

The solutions according to the invention which, in particular, increase operator safety, can basically be employed in both the above-treated types of bottle top dispensers, that is to say with a co-moving outer housing and with an outer housing arranged fixedly on the valve block. The term "fixedly" means, in this context, that, in this variant, the outer housing is not moved in relation to the valve block when the piston of the cylinder/piston arrangement is moved. However, this outer housing may certainly be releasable from the valve block, in order to carry out repairs or a cleaning or sterilization of the cylinder and/or of the piston or of other subassemblies.

No liquid is dispensed as a result of actuation on the outer housing from above. On the one hand, the outer housing does not move when a force acting on it vertically from above is introduced. On the other hand, also, no projecting piston rod can be driven.

Basically, the above-explained measures can advantageously be implemented in a bottle top dispenser having a motor drive of the piston. There, however, the tendency to tilt in any event normally occurs to a lesser extent than in a manually actuated bottle top dispenser. Both variants of the present invention are therefore especially advantageous in a bottle top dispenser designed for manual actuation.

All the above-explained appliances for the metered handling of small liquid quantities in the field of chemistry, biology, pharmacy, etc. in the laboratory, in tests and in production have in common the fact that they have a cylinder/piston arrangement for the exact take-up and dispensing of liquid part volumes. In a cylinder, a sealed-off piston runs, from which a piston rod is led upward out of the cylinder. The movement of the piston rod is utilized in order to determine the travel of the piston accurately. In direct measurement of the piston rod, a displacement measuring strip is located directly on the piston rod and extends axially in the direction of the piston rod (German Patent DE-C-35 01 909). If a housing moves upward, together with the piston rod, with respect to the cylinder, the displacement measuring strip is expediently positioned on the housing or on another component connected to the piston rod in a fixed relative position. It is also possible, however, to provide the arrangement exactly in reverse, that is to say to assign the displacement measuring strip to a fixed component if a corresponding sensor arrangement is then assigned to the moving housing.

Furthermore, all the above-explained appliances have in common the fact that small and very small liquid quantities have to be determined accurately. In the prior art from German Patent DE-C-35 01 909, a highly accurate measuring arrangement with displacement measuring strip and sensor arrangement is already provided, in which the play of otherwise necessary reduction gears of a measurement system of conventional type is eliminated (German Patent Application DE-A-101 06 463 corresponding U.S. Pat. No. 7,244,397 B2). By the displacement measuring strip being arranged directly on the piston rod in this piston burette and by the direct read-off there by means of the sensor of the sensor arrangement, a substantial fault source is eliminated.

In this appliance, in the first place, it is proposed that the measuring strip be an optical scale and the sensor arrangement be a reflected light system. As an alternative, it is proposed that the measuring strip be part of a capacitive system which also includes the sensor. Electrodes standing opposite one another are in this case arranged such that two pairs of measuring capacitances for measuring the relative movement between the measuring strip and the sensor are formed.

As a third variant, in this appliance, it is proposed that the piston rod carry a magnetic strip. Here, fixedly in the housing and adjacently to the piston rod, a reading head is provided which is aligned with the magnetic measuring strip and is separated from this by a gap. An electronic control circuit is coupled to the reading head which reads off the measurement information on the magnetic measuring strip and feeds corresponding pulses into the control circuit. The latter converts the pulses and activates a digital indicator which, in turn, indicates the dispensed volume of liquid on the basis of the relative movement between piston and cylinder.

In the abovementioned direct arrangement of the displacement measuring strip on the piston rod, as described in German Patent DE-C-35 01 909, the measuring strip, too, is moved into the cylinder. The cylinder inner wall is wetted in this region with the liquid to be metered. The inner space is encapsulated by means of sealing-off measures, so that the sensor arrangement is also sometimes exposed intensively to vapors which occur.

If magnetized displacement measuring strips are used in portions, then incremental determination of the position of a piston rod and consequently of the piston in the cylinder can also be implemented.

For evaluation and for the corresponding software in incremental position determination, it is known to supply the periodic phase-shifted analog signals (sin; cos) delivered by the sensor to the evaluation circuit and to subject them to interpolation in accordance with an interpolation table. The periodic analog signals are digitized in the evaluation circuit, and the digital values are standardized for the purpose of assignment to the interpolation table. Comparatively high-speed, current-intensive and relatively costly analog/digital converters, etc. are required for this purpose (German Patent DE-C-34 17 016). Since the number of portions of the displacement measuring strip is limited for mechanical reasons (typically, a portion is about 1 mm long), a considerably higher resolution of the measurement values can be achieved only by a direct evaluation of the analog sinusoidal (and cosinusoidal) signals, instead of merely using their zero crossings. A sinusoidal signal and a cosinusoidal signal are obtained because two transducers sensitive to magnetic fields are normally adopted, which are offset with respect to the division of the displacement measuring strip such that they emit two signals offset by a quarter period with respect to one another.

Current consumption is an essential criterion for the illustrated appliances for the metered handling of small liquid quantities, the appliances obtainable commercially today managing with one battery for several years (General Catalogue of the Applicant, op. cit., page 31, "Burette Digital III").

Sensor arrangements known hitherto and their assigned evaluation circuits have a current consumption of well above 5 mA to about 25 mA during operation in the case of an interpolation rate of between 200 and 190. This necessitates batteries or accumulators of substantially heavier duty than is customary nowadays, which would have a life of only a few operating hours in such a circuit.

The problem on which the teaching is based thus far is, overall, to optimize the known appliance for the metered handling of small liquid quantities in terms of displacement measurement and its evaluation.

According to one aspect of the invention, the above-indicated problem of optimizing the measurement system in appliances of the type in question is achieved in that the sensor arrangement is arranged in a reception pocket closed completely with respect to the measuring strip. The sensor arrangement may be sealed in the reception pocket, if appropriate at the rear, by means of sealing compound, in order to ensure an optimal protective action for the sensor arrangement. This, of course, functions only with a measuring strip which is correspondingly suitable for this purpose.

In a non-optical sensor arrangement, in particular, one which is sensitive to magnetic fields, there is a correspondingly magnetized measuring strip. In an optical sensor arrangement, an optical scale is used.

The gas volume in the inner space surrounding the piston rod, said gas volume being displaced during suction, flows only past the sensor arrangement protected by the reception pocket. It can no longer coat the sensor as condensate and impair its function.

An expedient alternative has a wall portion of the reception pocket, the wall portion being designed as a film. This film should be extremely thin and have a low permeability for the gases which occur. Such a thin film may even consist of transparent material, so that the sensor of the sensor arrangement can operate optically.

According to a preferred teaching, there is provision, in this regard, for the reception pocket to be provided with long-hole connections which allow an exact alignment of the reception pocket with the measuring strip during installation in the appliance.

According to a further, particularly preferred refinement, there is provision for the sensor to be arranged in the reception pocket, on its side facing the measuring strip, behind a thin-layer wall portion of the reception pocket. The sensor has been brought as near as possible to the measuring strip, without actually touching this, and toward the inner space of the appliance, while preserving a gastight partitioning off of the sensor arrangement.

According to a further aspect of the invention, the problem referred to above is solved in that the sensor is designed as a magnetoresistive sensor system, in particular based on the AMR effect, and in that the evaluation circuit has a largely highly integrated cost-effective mixed-signal controller which evaluates the converted analog sensor signals directly via interpolation software.

Mixed-signal controllers are microcontrollers which link the various electronic processing functions, these precisely controllers also being suitable for evaluating the sensor signals via interpolation software, with the functions of an A/D converter. A mixed-signal microcontroller therefore replaces a three-stage arrangement of A/D converter, processing stage with processing software and output stage. Such a mixed-signal microcontroller can usually be used, at the signal level of AMR sensors, far more cost-effectively than a three-stage arrangement. Microcontrollers are offered with various power spectra by various suppliers (see, for example, the data sheet "MSP 430×33×MIXED SIGNAL MICROCONTROLLERS", February 1998, Texas Instruments). By means of a mixed-signal microcontroller, not only is a simple solution for signal processing provided, but, in particular, there is also very low current consumption both during operation and in the state of rest. (For detailed information, reference is made to the relevant data sheets, in particular the abovementioned data sheet).

Mixed-signal controllers can be implemented in various versions, for example, also as PSoC (Programmable System on a Chip), as DSP (Digital Signal Processor) or as FPGA (Field Programmable Gate Array). The latter has a purely digital input converter, so that a discretely preceding A/D converter can make the overall arrangement into a mixed-signal controller of the type described.

It is especially advantageous if evaluation by means of the evaluation circuit takes place with an ON/OFF duty factor of about 0.1 to about 0.02, preferably of between about 0.05 and about 0.03, in particular with an ON time of about 0.6 ms to about 0.1 ms, in particular of between about 0.3 ms and about 0.15 ms. Further, it seems to be particularly advantageous that the interpolation software operates with an interpolation rate of between 200 and 190, in particular of between about 400 and about 600, preferably of about 500.

By an appropriate duty factor being used, it is possible to reduce the current consumption of the measurement system according to the invention to less than one tenth of the current consumption of the interpolation ICs of the prior art, to be precise to below 200 μA during operation.

Overall, by means of the above-explained measures according to the invention, the measurement system based on magnetic field measurement can be markedly optimized in an appliance of the type in question.

In the appliance according to the invention, a set-up can be implemented which ensures reliable operation and at the same time simple handling. The current consumption of the measurement system is low and the costs of production are likewise lower than in conventional bottle top dispensers.

With a very high resolution of the detection of measured values, which can be achieved, for example, on account of a particularly expedient mechanical design of an appliance of the type in question, effects which have hitherto been ignored have an influence on the measurement results. In particular, the play of the piston rod in the piston drive becomes relevant. The lateral play in the piston drive allows lateral inclinations of the piston rod with respect to the piston which may falsify the measurement result in the case of high resolution.

Special importance is, in this case, again ascribed to the measures in a measurement system based on magnetic field measurement, for which the sensor detecting the magnetic field of the measuring strip should lie as near as possible to or on the longitudinal mid-axis of the piston rod of the cylinder/piston arrangement.

Further features relate to the type of fastening of the measuring strip on the piston rod, a preferred type of construction of the bottle top dispenser with a stabilizing frame, to a specific orientation of stops for the piston of the cylinder/piston arrangement and to further interesting and advantageous details. In this regard, reference should also be made to the following explanation of preferred exemplary embodiments that are explained in more detail below with reference to the accompanying drawings.

DETAILED DESCRIPTION OF THE INVENTION

Figure 1:
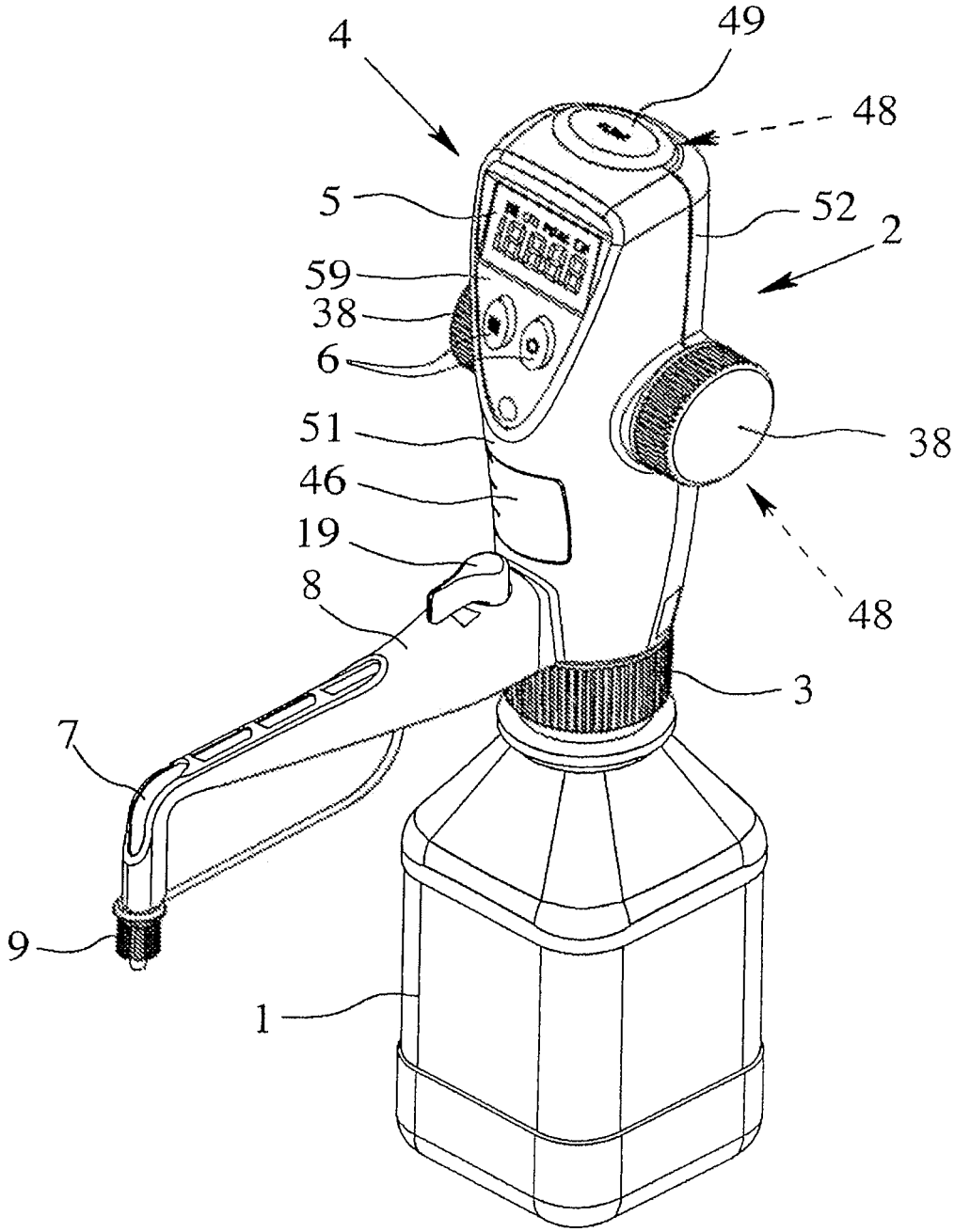
FIG. 1 is a perspective view of a bottle top dispenser in the form of a digital burette on a storage bottle.

FIG. 1 shows a preferred exemplary embodiment of a bottle top dispenser according to the invention for handling liquids, in the form of a burette.

In general terms, for bottle top dispensers for handling liquids, that are known as "liquid handling appliances," reference should be made to the General Catalogue of the assignee, "600 Generalkatalog—Laborgeräte von BRAND" ["600 General Catalogue—Laboratory Appliances of BRAND"] 09/01, pages 9 to 34. The design and use of bottle top dispenser dispensers and burettes are explained there.

Examples of burettes as bottle top dispensers were given in the introduction (German Patent DE-C-35 01 909; European Patent Application EP-B-0 096 088; and German Patent Applications DE-A-101 06 463 and DE-A-35 16 596). Bottle attachment dispensers may be gathered, for example, from German Utility Model DE-U-88 00 844 and, in particular, European Patent Application EP-A-0 542 241, which is also dealt with further below.

The definitions of top and bottom and of front and rear, which were stipulated in the introduction of the description, apply to the bottle top dispenser which is described hereafter. The bottle top dispenser is always explained in the position illustrated in FIG. 1 on a storage bottle, even if it is not illustrated in this position.

The bottle top dispenser illustrated in FIG. 1 is located on a storage bottle 1 during operation. It has an outer housing 2 and is fastened, here screwed, overall on a bottle neck of the storage bottle 1 by means of a fastening arrangement 3, here a cap nut. On top of the outer housing 2, and oriented to the front, is located an indicator 4 with a display 5, in particular for digital indication, preferably with LCD elements, and also with actuating elements, in particular actuating buttons 6.

From the outer housing 2, a discharge line 7 projects to the front, which, in the exemplary embodiment illustrated, is arranged in an angular holder 8 and is closed at the end by means of a closure cap 9 for closing purposes and as drip protection.

Figure 2:
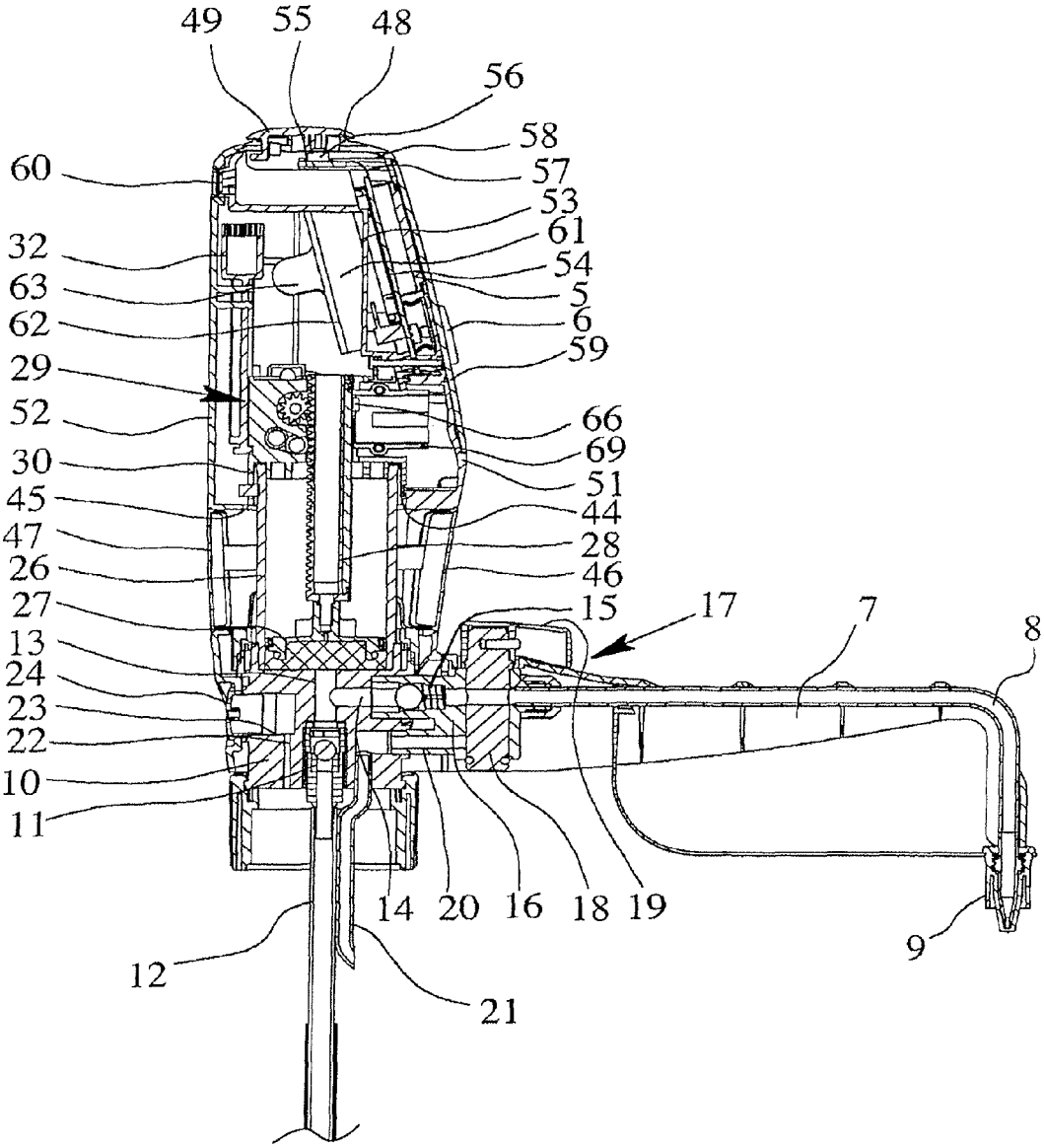
FIG. 2 shows the bottle top dispenser of FIG. 1 in a vertical section from front to rear without a storage bottle.

Details of the bottle top dispenser according to the invention may be gathered from the sectional illustration in FIG. 2.

The bottle top dispenser illustrated has in the outer housing 2, and a valve block 10. Attached to or formed integrally on the valve block 10 is the, already mentioned, fastening arrangement 3 by means of which the valve block 10 is actually fastened on the storage bottle 1. The outer housing 2 is then, consequently, also fastened on the storage bottle 1 at the same time.

The exemplary embodiment illustrated and preferred shows that the valve block 10 as a component which is produced in one piece from plastic, in particular from chemical-resistant plastic, and this is provided with a multiplicity of ducts and fittings. The design largely corresponds in detail to the valve block of the bottle top dispenser which is known from European Patent Application EP-A-0 542 241 and belongs to the prior art.

The fastening arrangement 3 is designed as a cap nut that is freely rotatable with respect to the valve block 10. Located in a downwardly directed recess of the valve block 10 is a suction intake valve insert 11 followed downwardly into the storage bottle 1 by a suction intake line 12 which here is illustrated, shortened, for simplification. The suction intake valve insert 11 is followed upwardly in the valve block 10 by a suction intake duct 13, from which a discharge duct 14 (directed to the right in FIG. 2) branches off approximately at mid-height. Located in a recess of the valve block 10 on the discharge duct 14 is a discharge valve insert 15. This insert is part of a valve body 16, attached to the valve block 10, of a changeover valve 17. The changeover valve 17 is followed downstream by the discharge line 7 in the holder 8. In the sectional illustration in FIG. 2, the holder 8 runs arcuately and guides the discharge line 7 in the same arc, so that the discharge orifice points downward. The latter is closed there by means of the closure cap 9.

The changeover valve 17 has a stop cock valve body 18 in the valve body 16 which is rotatable about a vertical axis of rotation and which can be adjusted manually by means of a toggle 19 which can also be seen in FIG. 1. A return duct 20 runs in the valve body 16 below the discharge valve insert 15, the return duct 20 continuing in the valve block 10 as far as a downward extending return line 21.

In the position of the toggle 19, illustrated in FIG. 2 and as can be seen in FIG. 1, the changeover valve 17 is switched so that the discharge duct 14 is connected to the discharge line 7 by a passage in the stop cock valve body 18. By contrast, in a position of the stop cock valve body 18 rotated through 90° with respect to the illustrated position, the discharge duct 14 is connected to the return duct 20, so that liquid circulating from the storage bottle 1 is conveyed back into the storage bottle 1 again by the return line 21. For the overall background of this "return metering," as it is known, reference should be made particularly to the detailed explanations in European Patent Application EP-A-0 542 241.

Furthermore, the valve block 10 contains, near the back side, a bottle ventilation line 22 which issues in a radially open plug receptor 23 directed to the rear. Located in the plug receptor 23 is a plug or a similar closing element 24 that closes the plug receptor 23 except for a small admission orifice in the plug 24, so that the interior of the storage bottle 1 is connected to the ambient atmosphere via the bottle ventilation line 22 and this admission orifice in the plug 24. Pressure compensation for the storage bottle 1 is thereby possible.

A cylinder 26, preferably and also here made of glass, is firmly attached, sealed off with respect to the valve block 10, in a cylinder receptor 25 made here in one piece of chemical-resistant plastic material, for example, of PFA. In concrete terms, the cylinder 26 is pressed in the cylinder receptor 25.

As regards the particulars relating to various plastic materials, together with their abbreviations, reference is made to the relevant specialized literature and also to the abovementioned General Catalogue of the assignee, here, in particular, pages 224 and 225.

Located in the cylinder 26 is a piston 27 running, sealed off, in the latter and having a piston rod 28 led upward out of the cylinder 26. Above the cylinder 26 is located a piston drive 29 that is drive-connected to the piston rod 28.

Whereas, in the region of the valve block 10, the bottle top dispenser illustrated is designed correspondingly to the already comprehensively known and highly proven prior art, the design is essentially different therefrom in the region of the cylinder/piston arrangement.

Figure 3:
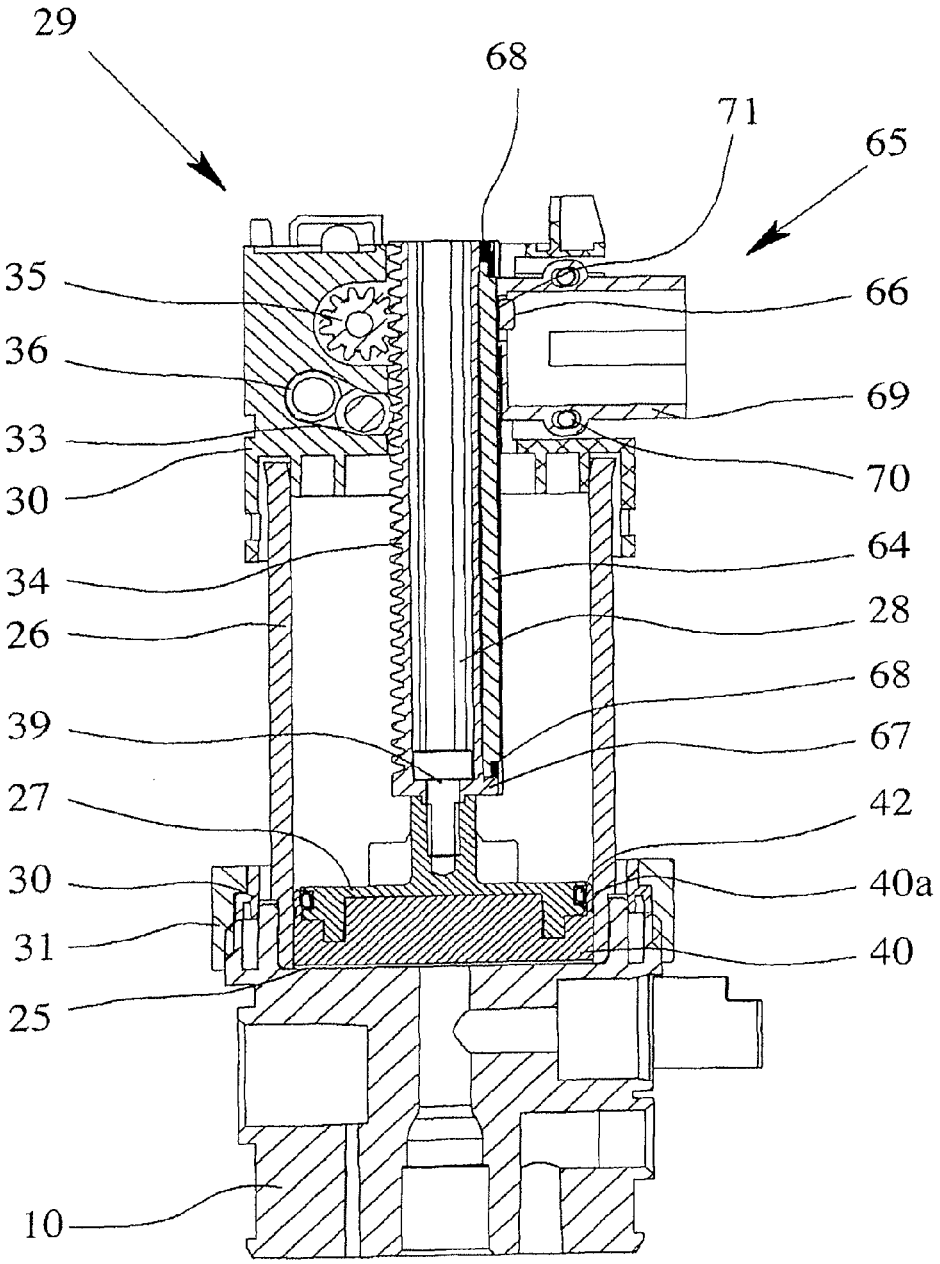
FIG. 3 shows, in section, an enlarged illustration of the valve block and frame with fittings of the bottle top dispenser according to FIG. 2, in the same sectional position as FIG. 2.
Figure 4:
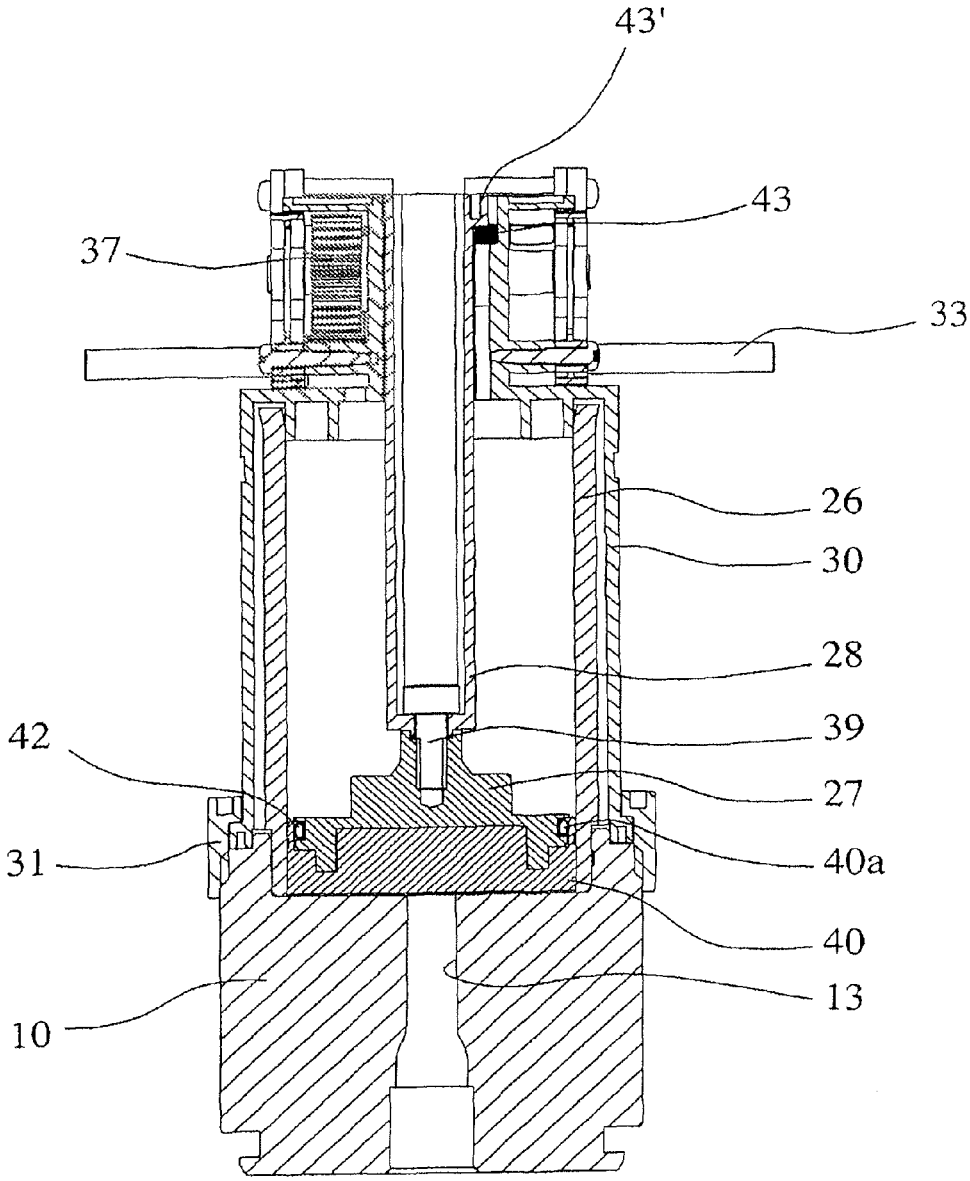
FIG. 4 shows the parts illustrated in FIG. 3, in a vertical section, with a sectional position offset by 90° with respect to FIG. 3.

FIG. 2, in conjunction with FIGS. 3 & 4, makes it clear that, first, a carrying frame 30 surrounding the cylinder 26 and extending upward beyond the cylinder 26 is provided. This frame 30 is firmly connected at the lower end to the valve block 10 in an axially exactly defined position, but is basically releasable from the valve block 10. The releasability of the frame 30 from the valve block 10 is implemented here in that an external thread is provided at the upper margin of the valve block 10, and in that the frame 30 has at the bottom a flange which is provided with a cap nut 31 having an internal thread.

The larger illustration in FIGS. 3 & 4 makes it clear that the cap nut 31 is guided in the frame 30 and can shift upward. Therefore, the frame 30 can be brought with its lower margin into the desired position on the valve block 10. Then, with this position being preserved, the cap nut 31 can be screwed onto the external thread on the valve block 10 and the frame 30 can thus be fixed with respect to the valve block 10.

It would basically also be possible firmly to connect the frame 30 inseparably to the valve block 10 or even to produce it in one piece with the latter, as was indicated in the initially explained prior art for the casing of the cylinder. For reasons of the cleaning, sterilization and repair of such a bottle top dispenser, however, it is advantageous to provide a fixed, but basically releasable connection of the frame 30 to the valve block 10.

It is essential for the frame 30, furthermore, that it also receives or carries the piston drive 29. This means that, although the piston drive 29 does not have to be part of the frame 30, nevertheless the frame 30 constitutes the carrying component for the piston drive 29 and determines the position of the latter in relation to the valve block 10. In the illustrated and thus far preferred exemplary embodiment, the frame 30 is upwardly widened or prolonged in a block-like manner and there has various recesses for reception of various parts of the piston drive 29. This is also dealt with later.

As already indicated above, finally, an outer housing 2 is connected releasably to the valve block 10. This outer housing surrounds the frame 30 on the outside, that is to say forms the outer envelope of the bottle top dispenser and protects the internal components. The outer housing extends beyond the piston drive 29 on the frame 30, in any event somewhat upwardly, and in the illustrated and preferred exemplary embodiment is closed on top.

Furthermore, the illustrated and preferred exemplary embodiment makes it clear in FIG. 2, in conjunction with FIGS. 3 & 4, that the cap nut 31 cannot readily be actuated here. Instead, for safety reasons and for reasons of accessibility in the outer housing 2, there is provision whereby the cap nut 31 can be actuated only by means of a special tool 32. This tool 32 can be seen in FIG. 2 mounted at top left in a holder on the back side of the outer housing 2.

The dimensional conditions, which can be seen particularly clearly in FIGS. 3 & 4, reveal that the illustrated and preferred exemplary embodiment, irrespective of what was stated above, is distinguished in that the stroke quotient, that is to say the ratio of the maximum stroke travel of the piston 27 to the effective diameter of the piston 27, is between 1 and 3, preferably between 1.3 and 2.2. The significance of these dimensional conditions, and in particular, of a shorter stroke travel of the piston 27 of about 50 mm, as compared with the stroke travels of about 19 mm known from the prior art, was explained in detail in the Background part of this specification.

The short stroke travel of the piston 27 in the bottle top dispenser according to the invention makes it easier to have a closed version of the outer housing 2, because the complete stroke travel of the piston rod 28 can be deployed inside the outer housing 2. The outer housing 2 must nevertheless not be designed with an excessive height. Also, for example, it must not co-move completely or partially with the piston rod 28.

The design according to the invention thus increases the operating reliability of the bottle top dispenser. The lower the bottle top dispenser is, the higher is the stability of a storage bottle 1 equipped with such a bottle top dispenser. In the exemplary embodiment illustrated, for the nominal volume of 25 ml, the stroke quotient has a value of just 2.0 and, for the nominal volume of 50 ml, a value of about 1.4. In the case of a nominal volume of 19 ml, which would constitute an arrangement of somewhat unusual size, there would be a value of about 1.0, which would therefore mean an effective diameter of the piston 27 of about 50 mm.

The design of the cylinder 26 as a calibrated glass tube of extremely high precision further increases the accuracy of the bottle top dispenser overall. The use of a calibrated glass tube as the cylinder 26 is expedient and relevant here on account of the measures otherwise taken.

The upper part of the frame 30 above the cylinder 26 is appropriate as a guide for the upwardly and downwardly moved piston rod 28 in the radial direction. Moreover, FIGS. 3 & 4 show that a driveshaft 33 of the piston drive 29 is mounted in the upper part of the frame 30.

Various possibilities are afforded for the upward and downward displacement of the piston rod 28. If direct measurement on the piston rod 28 is provided, slip between the driveshaft 33 and the piston rod 28 would be unimportant, and therefore, a friction wheel gear could even be used. Alternatives are a spindle drive or the like. The illustrated and preferred exemplary embodiment resorts to the expedient and proven technique of a rack and pinion drive. For this purpose, there is provision here for the piston rod 28 to have an axially running rack with teeth 34, preferably on the back side, and for the driveshaft 33 to carry a pinion 35 meshing with the rack teeth 34 so as to be gearingly coupled to said pinion. FIG. 3, in conjunction with FIG. 4, makes it clear that, in fact, a reduction gear is provided here, with an intermediate shaft 36 and with a further gearwheel 37.

In order to engage axially the piston rod 28 as exactly as possible and also to introduce forces to the outer housing 2 as centrally as possible, there is provision, in the illustrated and preferred exemplary embodiment, for the pinion 35 and the driveshaft 33 to be arranged on the back side of the piston rod 28, near the longitudinal mid-axis of the frame 30. This arrangement does not give rise to any additional torques on the piston rod, apart from the transverse forces caused by the locally arranged gearwheel drive. The influence on the measured value detection, described later, of the piston stroke is consequently limited. This leads to further increased operating reliability and also to a convenient actuation of the piston drive 29.

The piston drive 29 can basically be of motive design. For this purpose, an electric drive motor would be integrated in the outer housing 2. This entails considerable costs and leads to a substantially more complicated bottle top dispenser. Thus, the primary aim of the invention is to have a manually actuated bottle top dispenser with electronic, in particular digital, measured value detection and indication. FIGS. 1, 3 & 4 show, thus far, that the piston drive 29 is designed for manual actuation, and the driveshaft 33 carries on one end or at each end a manual actuation knob 38 outside the outer housing 2. The two manual actuation knobs 38 can be seen at left and right on the outer housing 2 in FIGS. 1 & 5.

Overall, according to the preferred teaching, the gearing connection between the driveshaft 33 and the pinion 35 is configured such that a rotation of the manual actuation knob (s) 38 to the front and downward cause(s) a downward movement of the piston 27. Ergonomic investigations have revealed that good metering accuracy can be combined optimally with a rapid take-up or dispensing of large liquid quantities if the maximum stroke travel of the piston 27 corresponds to five to ten times that of the manual actuation knob 38.

For the desired accuracy of the bottle top dispenser, which, as was explained in the Background part of the description, is considerably better than in all bottle top dispensers known from the prior art, the configuration of the piston 27 in the cylinder 26 is also important. For rigidity reasons, there may be provision for the piston 27 to be produced in one piece with the piston rod 28 or to be produced as a separate part and firmly attached, in particular screwed, to the piston rod 28.

The exemplary embodiment illustrated shows the piston rod 28 and the piston 27 screwed to it by means of a central fastening screw 39. The piston 27 here carries a sliding connection piece 40 surrounding it on the bottom side and circumferentially that is of a material of very high slidability (low coefficient of friction), in particular PTFE.

The sliding connection piece 40 forms a sliding ring **40*a* which bears under pressure against the cylinder 26 and which, for the generation of pressure, is backed with a spring ring 42 supported on the piston 27 that is likewise made of a preferably chemical-resistant material. The spring ring 42 is illustrated in the drawing as a hollow chamber ring, for example, made of chemical-resistant elastomeric material. It is essential that the sliding ring 40*a* itself does not have to apply the force in order to achieve the sealing action of the sliding connection piece 40 on the inner surface of the cylinder 26. This is assumed by the spring ring 42 which is adapted for this purpose. Moreover, while hardly able to be seen in the drawing, the outer circumferential surface of the sliding ring 40*a*** may also be structured, for example, in order to implement a multiple-flight stripper ring.

For the accuracy achievable by means of the bottle top dispenser, it is also advantageous that, as provided in the exemplary embodiment illustrated, the piston 27 is not moved downward against the valve block 10, but, instead, the piston rod 28 or the piston 27 engages against a stop 43. The stop 43 can be seen in FIG. 4 and cooperates with a counterpiece 43' on the piston rod 28. The stop 43 may be adjustable and in any event should be removable, so that the piston 27, together with the piston rod 28, can be drawn out, for example, for cleaning or sterilization measures.

This measure makes it possible, even in the lowest position of the piston 27, to leave a small gap with respect to the valve block 10 or to the bottom of the cylinder 26. Unevennesses here then cannot cause any disturbance. The illustrated arrangement is particularly advantageous in which the stop 43 engages on the piston rod 28 near the piston drive 29. As a result, the stop 43 and the force engagement point of the piston drive 29 on the piston rod 28 lie near to one another.

It was already pointed out above that it is particularly expedient if the outer housing 2 can be closed upwardly. This is possible if the arrangement is such that the piston rod 28 is located completely inside the outer housing 2 even when the piston 27 stands in the highest position in the cylinder 26.

For high accuracy in working with the bottle top dispenser, it is advantageous if the inclusion of air bubbles in the liquid in the cylinder 26 can be detected. In the event that the frame 30 is not designed as an open structure, but as an essentially closed housing, this being the case in the present exemplary embodiment (see, in particular, FIG. 2 and FIG. 4), it is recommended to provide the frame 30 in any event with a front viewing cutout 44 or a corresponding window, and as provided here (FIG. 5), with a rear viewing cutout 45 or a corresponding window. It is thereby possible to look into the glass cylinder 26 from the front or from the rear.

Since there is an outer housing 2 here, however, a viewing cutout or a window in the frame would be of no use if the outer housing 2 did not have a corresponding viewing window 46 or 47 that overlaps with the viewing cutout 44, 45 or window of the frame 30. Such a viewing window may, if appropriate, have a UV-protective coloring, for example, a brown color. The front viewing window 46 in the outer housing 2 can also be seen in FIG. 1.

It was already pointed out in the general part of the description that bottle top dispensers of the type in question are often also used with chemically aggressive liquids which generate corresponding vapors. In particular, a wetting of the inner wall of the cylinder 26, level with the piston rod 28, is unavoidable and leads to corresponding vapors. It is therefore particularly advantageous to ventilate the outer housing 2 permanently. Ventilation orifices 48 are recommended for this purpose, which expediently, to achieve convection, are arranged centrally, for example, concealed under the manual actuation knobs 38, or at the bottom near the valve block 10 and at the top near the upper end of the outer housing 2. The illustrated and preferred exemplary embodiment shows in this case upper ventilation orifices 48 arranged on the head of the outer housing 2, preferably under an actuating button 49 arranged on the top side.

It can be seen in FIG. 1 that there is a large-area actuating button 49 on the top side of the outer housing 2 which is labeled with the word "clear," and constitutes a zero position button. Such a button is often actuated when working with a burette. The actuating button 49 on the top side of the outer housing 2 is designed as a pushbutton. Its actuation therefore takes place by pressure on the outer housing 2 from above. Quick and fault-free actuation is thereby possible, without a serious tilting movement being exerted on the bottle top dispenser and on the storage bottle 1 located underneath it. Contrary to the actuating buttons 6 arranged on the front side of the outer housing 2, there is therefore no need to prop up the outer housing 2.

The large-area actuating button 49, at the same time, affords the possibility of concealing beneath it the ventilation orifice 48 located there. This is shown in FIG. 2.

It has already been pointed out in connection with the explanation of the prior art that, for reasons of the repair, cleaning and sterilization of the parts of the bottle top dispenser which are in contact with the media, it would be expedient to configure the outer housing 2 so as to be openable. In the exemplary embodiment illustrated, for this purpose, there is provision for the outer housing 2 to have a front housing shell 51 and a rear housing shell 52 that is releasably connected to the front housing shell 51. In the exemplary embodiment illustrated, see FIGS. 2 & 5, the front housing shell 51 is suspended at the rear on the valve block 10 and is firmly anchored to the frame 30 centrally (or at the top). To be precise, it is screwed on there.

Figure 5:
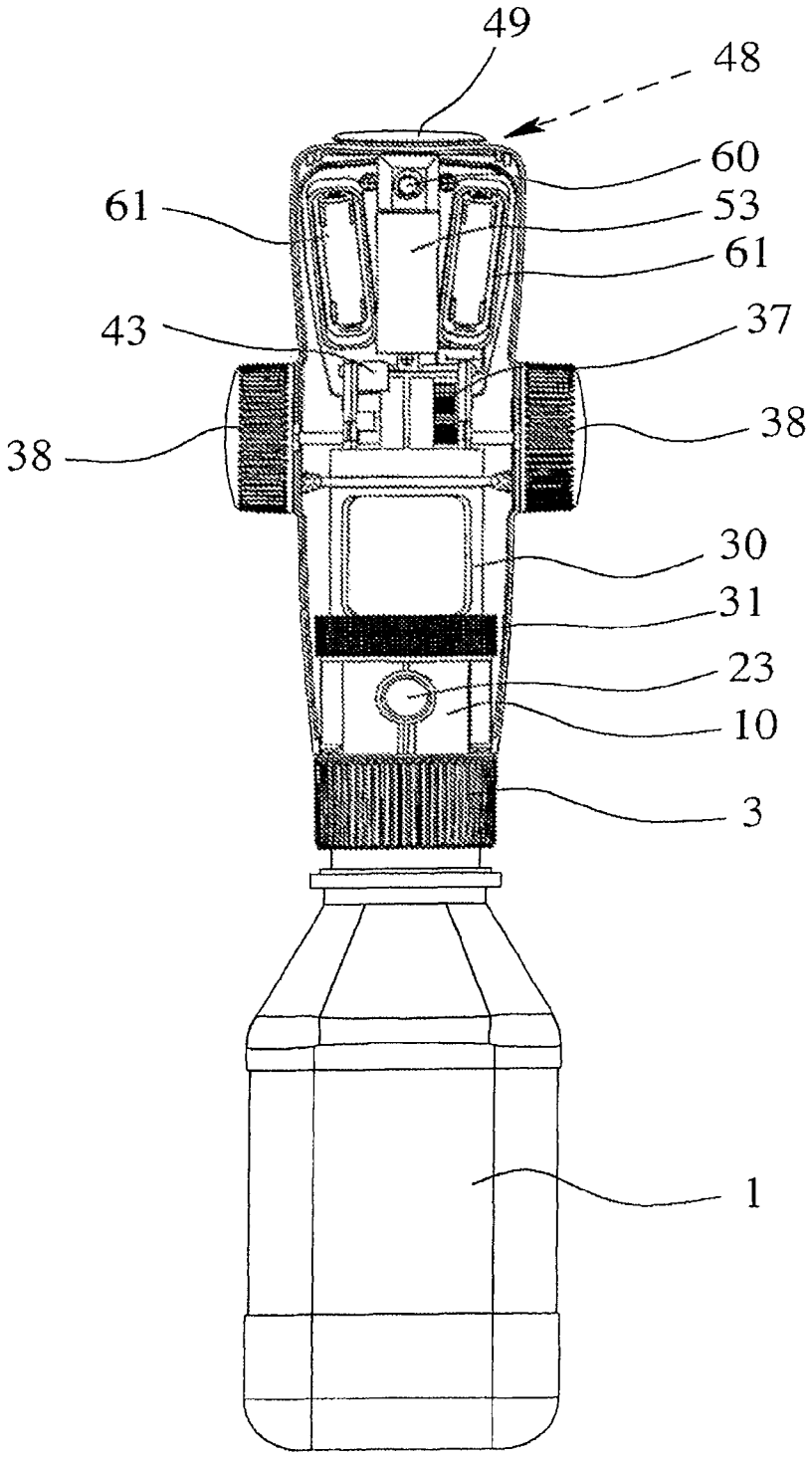
FIG. 5 shows the bottle top dispenser from FIG. 1, as seen from the rear, the rear housing shell being removed and the lids of the battery compartments likewise being removed.

In the exemplary embodiment illustrated, the rear housing shell 52 is suspended at the top on the front housing shell 51. It is fixed at the bottom to the valve block 10 by means of the plug 24 which is seated in the plug receptor 23 and which belongs to the bottle ventilation line 22. Other fixing possibilities are also afforded, for example, here too, by means of a screw. The simultaneous use of the plug 24 is expedient here, also because this is accessible particularly easily from the back side of the bottle top dispenser. In FIG. 5, the rear housing shell 52 has been removed, and the plug 24 is correspondingly also absent.

The drawings, in particular FIGS. 2 & 5, show further particular features of the configuration of the inner space of the outer housing 2. First, the outer housing 2 has located in it, here in the front housing shell 51, more precisely attached to the latter, a reception compartment 53 which is accessible from the rear (as here), from the front and/or from above, but which is otherwise closed with respect to the inner space of the outer housing 2. This reception compartment 53 serves for the reception of electronic devices, in particular a printed circuit board 54. The electronics of the indicator 4, including the display 5, are also located in the reception compartment 53.

In the illustrated and preferred exemplary embodiment, in which the actuating button 49 is located on top of the outer housing 2, the reception compartment 53 is continued, under the actuating button 49, angularly into the rear housing shell 52. As a result, the electronic devices under the actuating button 49 can also be protected in this reception compartment 53. In particular, here, these comprise a further board 55 which carries a pushbutton 56 actuated by the actuating button 49. In the illustrated and preferred exemplary embodiment, this further board 55 is connected to the circuit board 54 via a film hinge 57 and is itself seated in a push-in holder 58 of the reception compartment 53. In the illustrated and preferred exemplary embodiment, the film hinge 57 is formed by a circuit foil web.

The reception compartment 53 could be closed off to the front by means of a compartment lid 59 which, if appropriate, also carries the indicator 4 and the actuating buttons 6. The reception compartment 53 could then be equipped from outside, with the compartment lid 59 removed.

In all cases, the entire region is partitioned off inwardly against vapors, so that the sensitive electronics are well protected even during work with aggressive chemical media.

Moreover, an external connection 60 can also be seen in FIGS. 2 & 5 on the reception compartment 53 in the upper region extending as far as the rear housing shell 52. This connection, too, is guided, sealed off, to the rear housing shell 52. The connection 60 constitutes an outer interface of the electronic devices which can be utilized in any usual way desired.

While, in FIG. 2, the ventilation orifice 48 below the actuating button 49 serves for ventilating the reception compartment 53, ventilation orifices, indicated in FIG. 5, lying laterally below the actuating button 49 are, moreover, responsible for ventilating the inner space of the outer housing 2. It can be seen in FIG. 5, in this regard, that the reception compartment 53 is in any event narrower in the region extending to the rear than the outer housing 2 and is arranged centrally.

Furthermore, it can be seen in FIG. 5, in conjunction with FIG. 2, that two battery compartments 61 are arranged, specifically on the right and left of the reception compartment 53, in the outer housing 2, specifically, here too, in the front housing shell 51, that is to say attached to the latter. Each battery compartment 61, moreover, is closed with respect to the inner space of the outer housing 2 by means of a lid 62. The lid 62 can be seen in FIG. 2, and it has a handling tab 63. The battery compartments 61 without the lids 62 and without the batteries can be seen in FIG. 5. Of course, the battery compartments 61, too, are sealed off by means of the lids 62 with respect to the vapors occurring in the outer housing 2.

It would basically be possible to make the battery compartments 61 accessible from the front side.

The two battery compartments 61 which can be seen in FIG. 5 leave between them a free space in which the piston rod 28 can move upward. Accordingly, the wall of the reception compartment 53 also has here a corresponding run which gives the piston rod 28 the necessary free space.

The openable configuration of the outer housing 2, with the essentially stationary front housing shell 51 and with the rear housing shell 52 easily removable from the latter, affords the possibility, simple for the user, of dismantling the cylinder/piston arrangement, of cleaning the piston 27, together with the piston rod 28, on the one hand, and the cylinder 26, on the other hand, and also, if necessary, of changing the piston 27 or the sliding connection piece 40.

Further particular features of the measured value detection will be explained with reference to FIG. 3.

In the illustrated and thus far preferred exemplary embodiment, there is provision whereby the piston rod 28 carries, preferably on the side lying opposite the tooth row 34, a measuring strip 64 extending axially on the piston rod 28, and whereby a sensor arrangement 65 with a sensor 66 aligned with the measuring strip 64 is arranged adjacent to the piston rod 28, preferably in the upper part of the frame 30. Here, therefore, a direct measured value pick-up on the piston rod 28 is provided, such as is basically known from the prior art initially explained. Play in the step-up devices, such as occurs in electromechanical measured value detections, is systematically ruled out here. This is particularly expedient here when the other measures for stiffening the mechanical arrangement and for increasing the accuracy are likewise taken.

The exemplary embodiment illustrated shows that the measuring strip 64 is positively oriented here on the piston rod 28 on one side. For this purpose, there is provision whereby the measuring strip 64 is introduced, with an axial stop 67 located on one side, in a pocket on the piston rod 28 and is sealed in by means of a preferably chemical-resistant sealing compound 68. The sealing compound 68 can be seen, on the one hand, at the bottom on the stop 67 in a small quantity and, on the other hand, on top of the upper end of the piston rod 28. A sealing compound 68 can be made chemical-resistant more easily than normal adhesives. Moreover, it has sufficient inherent elasticity in order to absorb the minimal displacements of the measuring strip 64 in relation to the piston rod 28.

Basically, measuring strips 64 consisting of plastic and mixed with magnetic powder can be used.

The above-explained minimal displacements of the measuring strip 64 in relation to the piston rod 28 originate from variations in length on the piston rod 28 and from the different thermal elongation of the piston rod 28 and measuring strip 64.

Figure 11A:
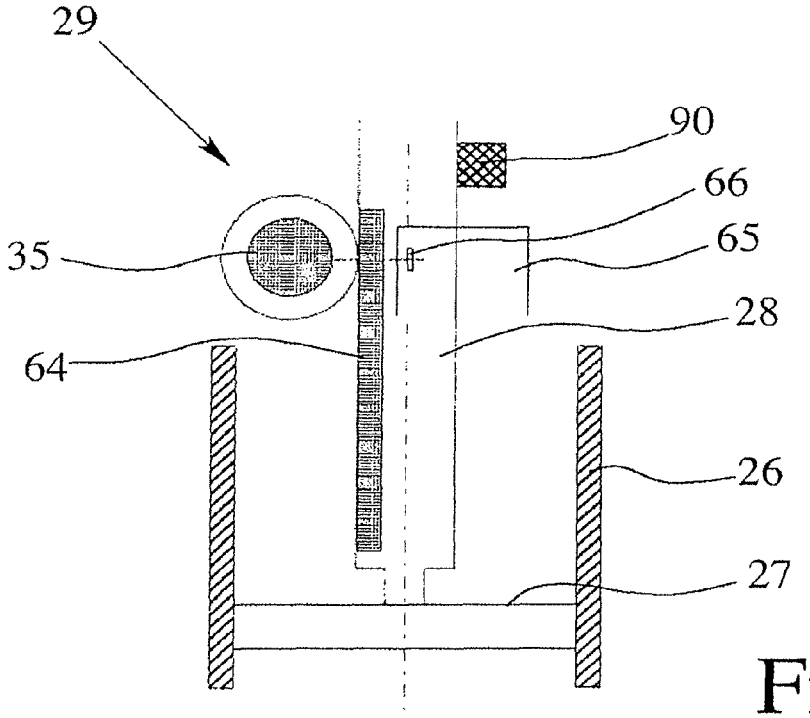
FIG. 11*a* shows a preferred exemplary embodiment of a cylinder/piston arrangement with measured value detection according to the invention for magnetoresistive measurement, with the piston rod in the desired position.
Figure 11B:
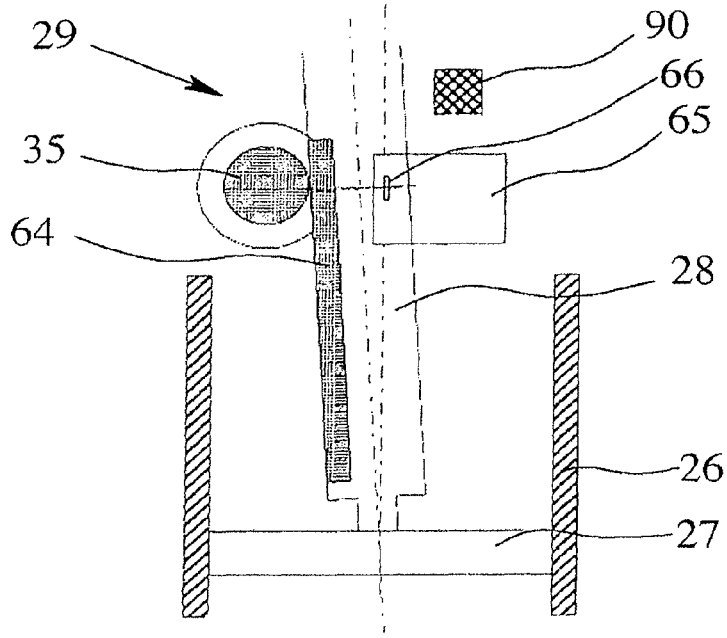
FIG. 11*b* shows the system from FIG. 11*a*, but in this case with the piston rod being deflected with respect to the desired position due to play.
Figure 12:
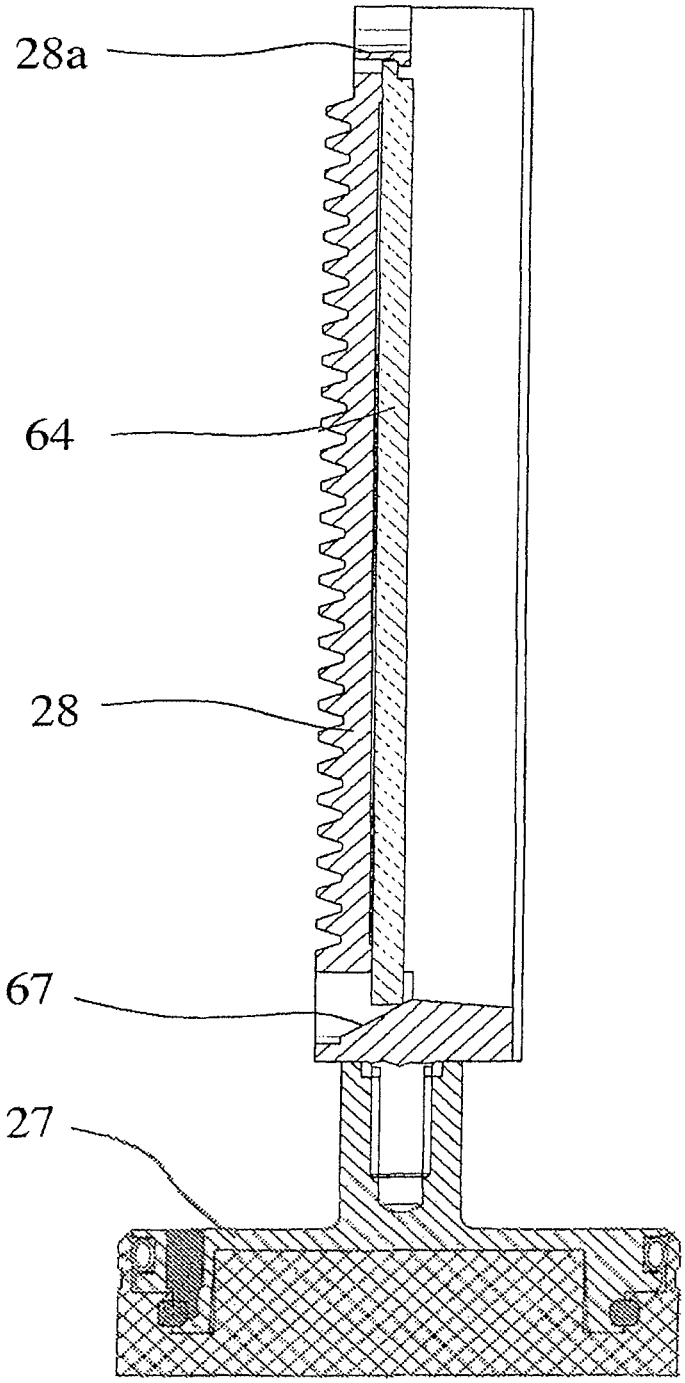
FIG. 12 shows in an enlarged illustration, in an orientation similar to FIG. 3, a piston with a piston rod having a measuring strip in a particularly expedient arrangement

FIG. 12 illustrates the subassembly with piston 27, piston rod 28 and measuring strip 64. In contrast to the version according to FIG. 2, the measuring strip 64 is arranged in the piston rod 28 near the mid-axis of the piston 27, as in the version according to FIGS. 11*a*, 11*b*. The measuring strip 64 is also not held, as in the version according to FIG. 2. In this version, the measuring strip 64 is seated vertically, near the piston 27, on the stop 67. The upper opposite end of the measuring strip 64 is displaced vertically downward onto the stop 67 by means of a spring element 28*a*. The two bearing surfaces are inclined, so that the measuring strip 64 is held in the direction of its lateral bearing contact on the piston rod 28.

In the version according to FIG. 12, the measuring strip 64 is not connected over its vertical length to the piston rod 28.

The version according to FIG. 12 retains the measuring strip 64 flexibly on the piston rod 28 by means of the spring element 28*a*. Temperature changes and different elongations have no influence on the fastening. Moreover, the mounting of the measuring strip 64 without aids and/or without a curing time is positive in terms of production and repair costs.

In the embodiment illustrated, the spring element 28*a* and the piston rod 28 are produced in one piece. The spring element 28*a* could also be a separate component which is fastened to the piston rod 28 and which consists of another material having good elastic properties. The spring element 28*a* could likewise be configured such that it holds the measuring strip 64 in the direction of its lateral bearing contact on the piston rod 28 positively, for example by means of an integrally formed clip.

The structural details of a bottle top dispenser which have been described hitherto are not bound to the measuring principle of the displacement measurement system. According to preferred teaching, which is also thus far illustrated in the drawings, a measurement system sensitive to magnetic fields is adopted. However, optoelectronic and capacitive measurement systems may sometimes also be considered for the various teachings of the present invention.

In particular, there is provision here for the displacement measuring strip 64 (measuring strip 64) to be magnetized, spaced apart, in portions or to be magnetized contradirectionally in portions, specifically with a division of between 0.3 mm and 2.0 mm, preferably, and as a compromise between resolution and costs, approximately 1.0 mm.

The illustrated and thus far preferred exemplary embodiment shows a particularly expedient version of a non-optical sensor arrangement 65, in particular of a sensor arrangement 65 sensitive to magnetic fields. This is located in a reception pocket 69 closed completely with respect to the measuring strip 64 or to the inner space of the outer housing 2. This reception pocket, in the exemplary embodiment illustrated, is inserted into the frame 30, to be precise is screwed to the latter by means of long-hole connections 70. The long-hole connections 70 make it possible to align the reception pocket 69 exactly with the measuring strip 64. In the illustrated and preferred exemplary embodiment, in this case, there is provision for the sensor 66 of the sensor arrangement 65 to be arranged in the reception pocket 69, on its side facing the measuring strip 64, behind a thin-layer wall portion 71. The aim of the arrangement is to bring the sensor 66 as near as possible to the measuring strip 64, without actually touching the latter, and while preserving a gastight partitioning off of the sensor arrangement 65 with respect to the inner space of the outer housing 2.

Figure 6:
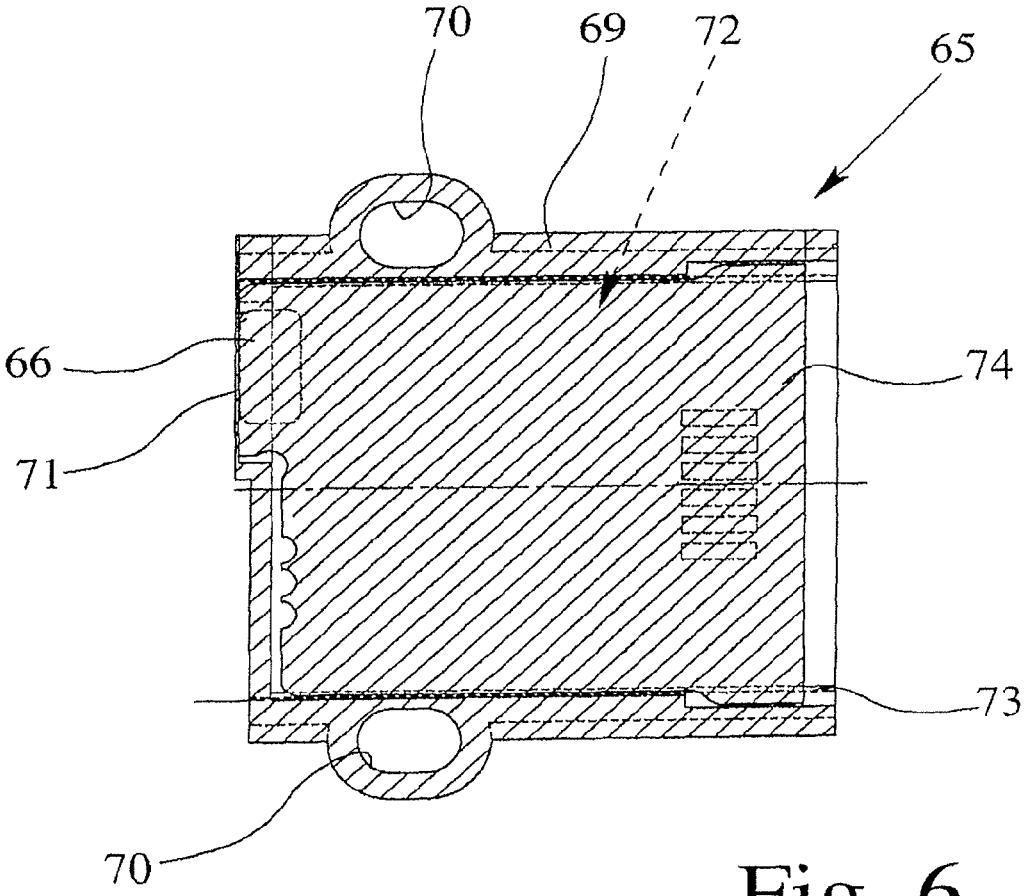
FIG. 6 shows the sensor arrangement in the reception pocket in an enlarged illustration, but in the same orientation as in FIG. 2.
Figure 7:
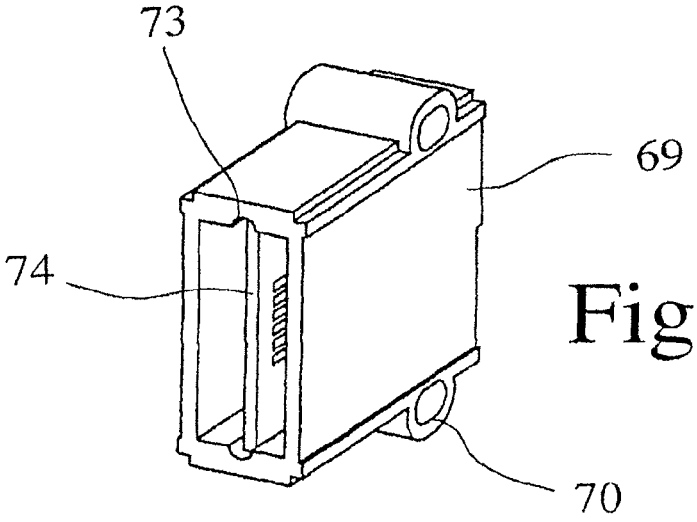
FIG. 7 shows the reception pocket with the sensor arrangement located in it in a perspective view obliquely from the rear.
Figure 8:
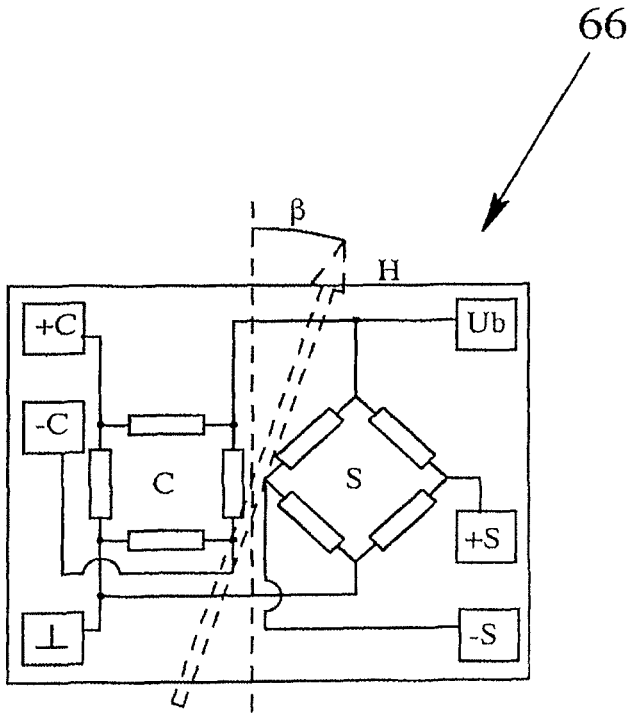
FIG. 8 shows a basic circuit diagram of an AMR sensor which can be used as a magnetoresistive sensor in the measurement system according to the invention.

Details of the sensor arrangement 65 with the sensor 66 in the reception pocket 69 are illustrated in FIGS. 6, 7 and 8.

First, it can be seen in FIGS. 6 & 7 that the sensor 66 of the sensor arrangement 65 is seated on a board 74 that is pushed into the reception pocket 69 in a push-in guide 73, specifically at the front margin of said board, which margin bears directly against the thin wall portion 71 on the left in FIGS. 3 & 6. Here, the wall portion 71 has, for example, only a thickness of approximately 0.1 to 0.2 mm. As far as the selected division of the measuring strip 64 is greater, the distance of the sensor 66 from the measuring strip 64 may also become greater. Wall portions can then be designed which can be produced in a simpler way, in particular are injection-moldable, and which regularly will have a somewhat greater wall thickness of around 0.5 mm.

The reception pocket 69 is formed, overall, of a chemical-resistant, thermally stable, plastic material, in particular PEEK (polyaryletheretherketone). The length and width of the reception pocket 69 are about 20 mm, and the thickness is about 8 to 10 mm.

The wall portion 71 of the reception pocket 69 may also be manufactured separately instead of in one piece with the reception pocket 69. Then, it would subsequently be attached to the reception pocket 69. For this purpose, the reception pocket 69 may have an orifice in the region of the wall portion 71. A gastight foil may be welded onto such an orifice or be otherwise fixed to the reception pocket 69, with or without auxiliaries, so as to close the orifice. Such a gastight foil mostly has a thickness of approximately 10 μm to approximately 500 μm. This foil then forms the wall portion 71 which separates, in a gastight manner, the sensor 66 from the measuring strip 64. It is thereby possible to manage with a very short distance of 0.1 mm or less.

The sensor arrangement 65 also has on the board 74 the evaluation circuit 72 for evaluating the output signals of the sensor 66 and for activating the indicator 4. It is basically possible to set up the evaluation circuit 72 as a system solution with individual or a plurality of discrete structural elements. A space-saving and energy-saving and also cost-effective evaluation circuit 72 is achieved, using a mixed-signal controller which evaluates the converted analog sensor signals directly via interpolation software. However, the evaluation circuit 72 may also be implemented, with a straight-forward software solution in an extreme case, by means of a microprocessor or microcomputer, without departing from the meaning of the teaching of the present invention.

FIG. 7 shows a perspective view of the reception pocket 69, with an inserted board 74, obliquely from the rear. Here, the board 74 is not yet sealed in. The interface cable soldered to the board 74 and also sealed in is likewise not illustrated. There may be provision for sealing in the board 74 completely in the reception pocket 69, specifically likewise by means of a chemical-resistant sealing compound.

The completely separate block-like configuration of the sensor arrangement 65 in the reception pocket 69 is useful as a subassembly, to be handled independently, of an appliance of the type in question.

FIG. 8 shows an arrangement of a particularly expedient sensor 66 for a sensor arrangement 65 of an appliance according to the invention. There is provision, here, for the sensor 66 to be designed as a magnetoresistive sensor system based on the AMR effect. For details of this operating principle, reference should be made to the publication of Dr. Erik Lins, SENSITEC GmbH "Magnetoresistiv mit optischer Präzision" ["Magnetoresistive with optical precision"], of 1 Aug. 2005, the disclosure content of which is also made the disclosure content of the present invention by reference. This publication has been freely accessible on the Internet since August 2005.

Briefly, FIG. 8 shows two wheatstone bridge circuits, offset by 45° with respect to one another, so that a cosine signal (C) and a sine signal (S) are generated, taps at +C/−C and +S/−S. Operating voltage at Ub is grounded. The magnetization direction of the measuring strip 64 is defined by H, and the angle between H and the direction of the current flux is indicated by β. By forming the quotient of the sine and cosine (arc tangent function), the angle information becomes independent of the amplitude of the signals. As a result, on the one hand, the influence of temperature is minimized and, on the other hand, the operating distance between the sensor 66 and measuring strip 64 is not especially critical. The separate assessment of the sine and cosine signals affords some redundancy and, because the sum of the squares is equal to 1, allows a self-monitoring of the sensor 66 or offset amplitude correction.

Figure 9:
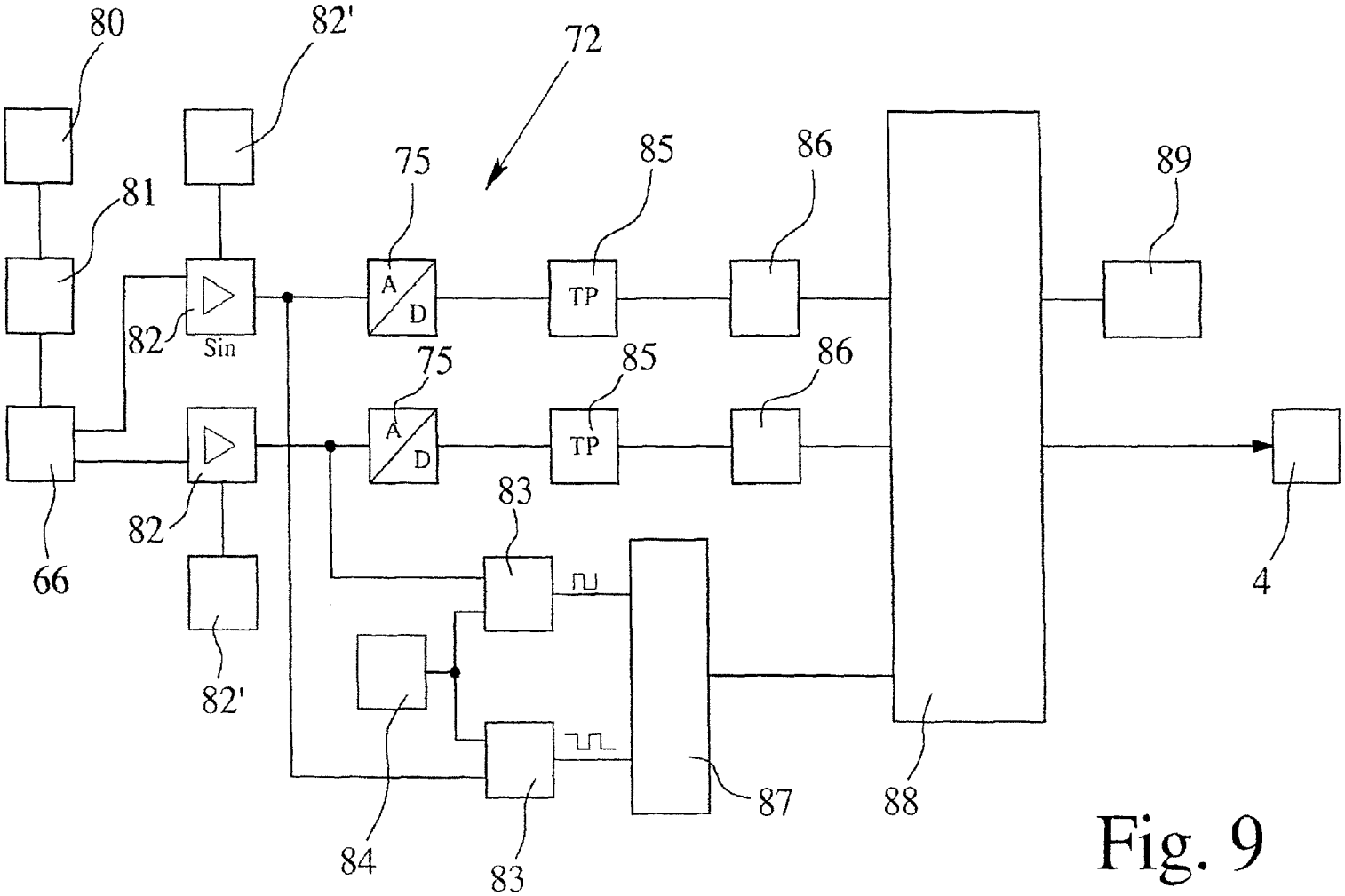
FIG. 9 shows an evaluation circuit for such an AMR sensor.

So that the already above-explained direct evaluation of the sinusoidal and cosinusoidal signals of the sensor 66 can be carried out in order to achieve good interpolation, a circuit arrangement 72, such as is illustrated as a block diagram in FIG. 9, is recommended. The sensor 66 is fed with a clocked supply voltage 80 which is readjustable at the sensor 66 via amplitude setting 81. The designated outputs (cos, sin) of the sensor 66 are connected to amplifiers 1, each with offset balancing 1'. Downstream of the amplifiers 1, there is a branch, on the one hand, to comparators 83 for comparison with a reference voltage 84 and, on the other hand, to analog/digital converters 75 with following subassemblies 85 and standardization stages 86. The subassemblies 75, 85, 86, 87, 88 and 89 are implemented in a mixed-signal controller in the present, thus far preferred solution. For further information on a mixed-signal controller, reference is made to the relevant statements and the literature reference which are contained in the general part of the description.

In the first branch having the comparators 83, quadrant recognition takes place in stage 87. All the signals are then fed to the interpolation stage 88 in which an ARCTAN table is stored. According to the formula $$\arctan\left(\frac{D\sin\beta}{D\cos\beta}\right),$$

the actual position of the piston 27 is determined and is displayed on the indicator 4. In parallel with this, an offset amplitude correction takes place in a correction stage 89 according to the formula $$D\sin^2\beta + D\cos^2\beta = A^2.$$

With regard to the current consumption of the measurement system, a magnetoresistive measurement system is in any case highly expedient, in any event substantially more beneficial than an optoelectronic measurement system. Furthermore, according to preferred teaching, there is provision here for evaluation by means of the interpolation software to take place with an ON/OFF duty factor of about 0.1 to about 0.02, preferably of between about 0.05 and about 0.03, in particular with an ON time of about 0.6 ms to about 0.1 ms, in particular between about 0.3 ms and about 0.15 ms. It is particularly recommended in this case that the interpolation software operates with an interpolation rate of between 200 and 190, in particular of between about 400 and about 600, preferably of about 500.

Figure 10:
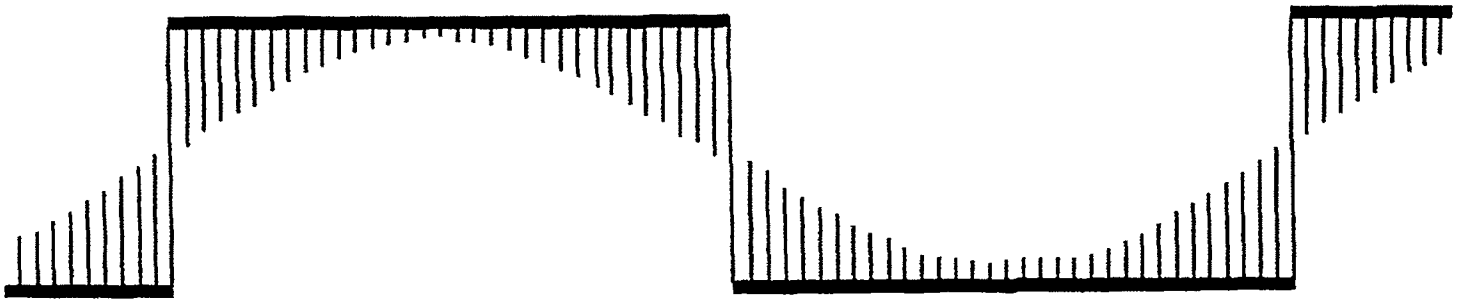
FIG. 10 is a graph showing an example of the keying in the preferred measurement system according to the invention.

This keying can be seen in the diagrammatic illustration in FIG. 10. The profile of the sine curve scanned here can be seen. It illustrates, as the time for measured value detection, an ON time of 200 μs by means of vertical blacked-in lines. In the gaps between the lines, the OFF time amounts in each case to 5.6 ms. The duty factor is therefore about 0.036 in this exemplary embodiment.

As compared with the interpolation ICs known from the prior art, the current consumption can be reduced to about 130 to 160 μA during operation if the intended interpolation is implemented with an interpolation rate of about 500. Mixed-signal controllers often have the possibility of selecting different power saving modes in which different components or terminals of the controller are switched to currentless or to conservation current. The mixed-signal controller mentioned by way of example in the description introduction has, for example, five different power saving modes which are all distinguished in that the central computer unit (CPU) is switched off. In general, such a mixed-signal controller with different power saving modes is to be preferred, because it can be coordinated optimally with the particular features of an appliance according to the invention.

It has been assumed here that, with a manually actuated appliance of the type in question, the speed of adjustment of the piston 27 will not be greater than about 50 mm/s. The interpolation rate is coordinated with this. This results in a resolution of the measurement travel of about 2 μm and an accuracy of the measured value over the full measurement range of about 10 μm, all this in a temperature range of +10° C. to about +40° C.

A further teaching, which again is independent per se, is explained by means of the exemplary embodiment of FIGS. 11*a* & 11*b*. In the illustrated and preferred exemplary embodiment, this design applies to a sensor system sensitive to magnetic fields, in particular a magnetoresistive sensor system.

FIG. 11*a* shows an exact orientation of the piston rod 28 on a side guide 90. There is provision here whereby a side guide 90 for the piston rod 28 is provided on the same side on which the sensor arrangement 65 is located, and the sensor 26 is arranged near to, preferably about level with, the side guide 90. What is thereby achieved is that, in the desired position of the piston rod 28 bearing against the side guide 90, the sensor 66, too, is aligned exactly in relation to the measuring strip 64 positioned on the piston rod 28. The parallelism of the measuring strip 64 with the sensor 66 is optimal over the entire adjustment travel of the piston rod 28.

FIG. 11*b* shows, in conjunction with FIG. 11*a*, that a measuring error with regard to displacement measurement in the axial direction could also arise as a result of an inclination of the piston rod 28 in the cylinder 26, particularly in relation to the piston 27. This measuring error is conspicuous in an appliance of the type in question because of the high precision which is otherwise achieved. It is caused by the fact that the piston rod 28 has some lateral play, for example of 0.3 mm, in the region of the piston drive 29. This leads to a minimal inclination of the piston rod 28 which, however, causes disturbance within the framework of the existing measuring accuracy and which gives rise to a displacement measuring error.

In the event of optical measurement, then, it is recommended to make this error as low as possible, in that the measuring strip 64 on the piston rod 28, on the one hand, and the sensor arrangement 65 with the sensor 66, on the other hand, are arranged such that, when the piston rod 28 is in the desired position, that surface of the measuring strip 64 which faces the sensor 66 forms a plane which lies as near as possible to or on the longitudinal mid-axis of the piston rod 28. This stipulation with regard to the arrangement of the measuring strip 64 on the piston rod 28 is based on the recognition that, in a reflected light system, the surface of the measuring strip 64 is the interface between the measuring strip 64 and sensor 66. If this interface is placed as near as possible to the longitudinal mid-axis of the piston rod 28, then the measuring error arising from the play-induced inclination of the piston rod 28 is minimized.

By contrast, in the magnetoresistive measurement system preferred according to the invention, the sensor 66 detecting the magnetic field of the measuring strip 64 lies as near as possible to or on the longitudinal mid-axis of the piston rod 28. This is illustrated in FIGS. 11*a, b*. The interface in the magnetoresistive measurement system is the sensor 66 through which the flux lines of the periodically magnetized measuring strip 64 pass. If the measuring strip 64 tilts away to the left, as shown in FIG. 11*b*, although the output region of the flux lines creeps somewhat downward, at the same time the tilt likewise causes the direction of the flux lines to tilt, and these run, directed slightly upward, from the measuring strip 64 in the direction of the sensor 66. At the interface, to be precise at the sensor 66, only the amplitude changes slightly, this being correctable, but not the phase position which is critical for displacement measurement.

For a capacitive sensor system with a corresponding measuring strip 64, the interface lies anywhere between the two orientations outlined above.

The above-explained short distance of the various interfaces from the longitudinal mid-axis of the piston rod 28, which distance is still acceptable for the measurement system, is, of course, dependent on the required resolution of the measurement system. Furthermore, the stroke quotient also indirectly influences the still acceptable minimized distance. In the case of a low stroke quotient, as a rule, the distance between the range of movement of the piston 27 and the side guide 90 for the piston rod 28 is likewise shorter. Thus, the play-induced inclination of the piston rod 28 is greater. The shorter the distance of the mounting of the piston is and the greater the play in these longitudinal guides is, the nearer to the longitudinal mid-axis of the piston rod 28 the interface must lie.

In the relative position of the measuring strip 64 and sensor 66, as implemented according to this particular teaching of the invention, the sensor 66 in the sensor arrangement 65 no longer lies next to the piston rod 28, but in a clear profile of the latter. It is recommended, accordingly, that the piston rod 28 has a recess or flattening making it possible to have the corresponding position of the sensor 66.

FIG. 12 shows an especially useful structural solution for fixing the measuring strip 64 in the piston rod 28, taking into account the above-explained boundary conditions. This has already been explained further above.

Basically, the above statements relating to the exemplary embodiment of FIGS. 11*a, b* also apply to an eccentric arrangement of the piston rod 28. However, the version is especially important in which the piston rod 28 is guided with its longitudinal mid-axis as near as possible to or on the longitudinal mid-axis of the cylinder 26 by means of the side guide 90, in conjunction with the piston 27 in the cylinder 26.

The exemplary embodiments illustrated show that the sensor arrangement 65 is not arranged on the outer housing 2, but on the dimensionally stable frame 30. Consequently, the entire measurement chain is concentrated completely on the frame 30, so that the dimensional stability of the latter leads to the excellent accuracy of the bottle top dispenser according to the invention.

As already explained above, there may be provision for the measuring strip 64 to be an optical scale and for the sensor arrangement 65 to be a high-resolution reflected light system, in particular with four reflected light diodes. The design in the region of the sensor arrangement 65 is then, of course, different from what was described above.

By means of the measures implemented according to the invention, the accuracy of measurements in the bottle top dispenser according to the invention can be increased to a correctness R of approximately +/−0.06% and to a coefficient of variation VK of approximately 0.02% in the case of nominal volumes of 25 ml and 50 ml. These are values, such as are otherwise achieved, at most, by high-precision motor-operated bottle top dispensers. The high accuracy of the bottle top dispenser according to the invention is also due to the fact that all the mechanically moved parts are axially fixed exactly and in a dimensionally stable manner with respect to the valve block 10. This, in conjunction with direct measured value detection directly on the piston rod 28, makes play compensation during reversal of the direction of actuation unnecessary.

By means of special structural measures, the occurrence of tilting moments on the bottle top dispenser is systematically avoided or is reduced to a minimum. In this regard, the comparatively low height of the outer housing 2 is also important, which, in spite of the stationary outer housing 2, is possible because a comparatively small stroke of the piston 27 is implemented.

Figure 13A:
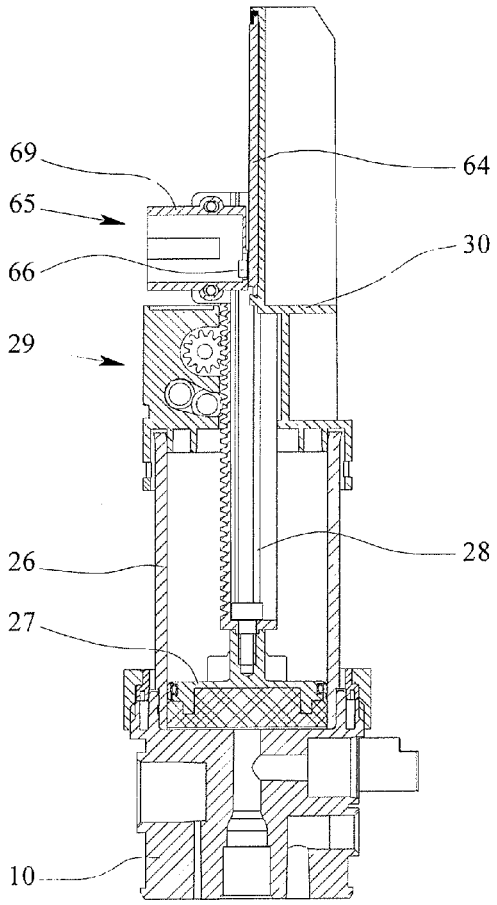
FIGS. 13*a* & 13*b* show an alternative arrangement in accordance with the present invention in which the positions of the sensor and measuring strip are exchanged, FIG. 13*a* showing the piston in the lowermost position and FIG. 13*b* showing the piston in the uppermost position.
Figure 13B:
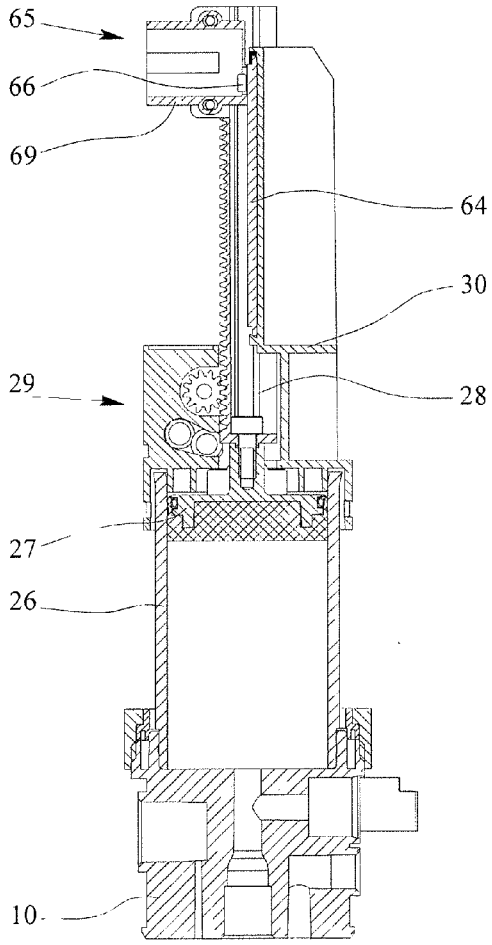

FIGS. 13*a* & 13*b* shows a modification of the embodiment shown in FIG. 3, wherein the positions of the sensor arrangement 65 and measuring strip 64 are exchanged. That is, measuring strip 64 extends axially in a direction of movement of the piston rod 28 and is fixedly mounted in the dispenser adjacent to the piston rod 28, and the sensor arrangement 65 is arranged directly on the piston rod 28 or on a component that is fixed relative to the piston rod 28 with its sensor 66 aligned with the measuring strip 64 and separated from the measuring strip 64 by only a narrow gap. By contrast to the embodiment shown in FIG. 3, the measuring strip is not arranged on the piston rod or on the component connected in a fixed relative position to it, but, instead, at a fixed location, and the sensor arrangement is attached to the piston rod or to the component connected in a fixed relative position to the latter.

As is apparent from FIGS. 13*a* & 13*b*, because the piston is flat (i.e., having only one longitudinally extending wall), U-shaped or L-shaped in transverse cross section, the measuring strip 64 is able to lie as near as possible to or on a longitudinal mid-axis of the piston rod, as is the case for the measuring strip 64 in the embodiment of FIGS. 11*a, b* where such is made possible by a similar shaping of the piston rod.

What is claimed is:

1. A bottle top dispenser for handling liquids, comprising:

a piston and cylinder arrangement for the exact take-up and dispensing of liquid volumes, with a cylinder and with a piston running, sealed off, in the cylinder and having a piston rod led upward out of the cylinder, a displacement measuring strip arranged directly on the piston rod or on a component connected to the piston rod in a fixed position relative thereto, the measuring strip extending axially in a direction of movement of the piston rod, and being magnetized, a sensor arrangement sensitive to magnetic fields which is arranged at a fixed location in the dispenser at a location adjacent to the piston rod or the component connected to the piston rod, the sensor arrangement having a sensor that is aligned with the measuring strip and separated from the measuring strip by only a narrow gap, an indicator for indicating the liquid quantity handled or to be handled, and an electronic evaluation circuit for evaluating analog output signals of the sensor and for activating the indicator, the electronic evaluation circuit being implemented by means of software of a microprocessor or microcomputer, wherein the sensor is a magnetoresistive sensor system, an analog-digital convert for converting the analog sensor signals, and wherein the evaluation circuit has a mixed-signal controller which evaluates the converted analog sensor signals directly via interpolation software.

2. The bottle top dispenser as claimed in claim 1, wherein the magnetoresistive sensor system is adapted to operate based on the AMR-effect.

3. The bottle top dispenser as claimed in claim 1, wherein the mixed-signal controller has a processing stage with processing software and an output stage.

4. The bottle top dispenser as claimed in claim 1, wherein the mixed-signal controller is one of a programmable system on a chip, a digital signal processor and a field programmable gate array with an A/D converter.

5. The bottle top dispenser as claimed in claim 1, wherein the interpolation software is adapted to operate with an ON/OFF duty factor of about 0.1 to about 0.02 with an ON time of about 0.6 ms to about 0.1 ms.

6. The bottle top dispenser as claimed in claim 5, wherein the interpolation software is adapted to operate with an interpolation rate of between 200 and 1000.

7. The bottle top dispenser as claimed in claim 1, wherein the interpolation software is adapted to operate with an interpolation rate of between 200 and 1000.

8. The bottle top dispenser as claimed in claim 1, further comprising an outer housing that is mounted over the piston and cylinder arrangement and is closed at a top side thereof, wherein at least one actuating button capable of being pressed downward for actuation is arranged on the top side of the outer housing, said actuating button being a zero set or resetting button.

9. The bottle top dispenser as claimed in claim 1, further comprising an outer housing that is mounted over the piston and cylinder arrangement and is closed at a top side thereof, wherein the outer housing is provided with ventilation orifices.

10. The bottle top dispenser as claimed in claim 9, wherein to achieve convection, the ventilation orifices are arranged at positions located at least one of centrally and at the bottom and at the top on the outer housing.

11. The bottle top dispenser as claimed in claim 1, further comprising an outer housing that is mounted over the piston and cylinder arrangement and is closed at a top side thereof, wherein the piston rod is located completely inside the outer housing even when the piston is in a highest position thereof in the cylinder.

12. The bottle top dispenser as claimed in claim 1, wherein the sensor arrangement is arranged in a reception pocket that is completely closed with respect to the measuring strip.

13. The bottle top dispenser as claimed in claim 12, wherein the reception pocket is provided with long-hole connections for exact alignment of the reception pocket with respect to the measuring strip.

14. The bottle top dispenser as claimed in claim 12, wherein a side of the sensor arranged facing the measuring strip is behind a thin-layer wall portion of the reception pocket, the wall portion having a thickness of about 0.1 mm to 0.5 mm.

15. The bottle top dispenser as claimed in 1, wherein the measuring strip is positioned in a pocket on the piston rod or a component connected to the piston rod and wherein an axial stop is located on one side in said pocket, said axial stop being the surface facing the piston.

16. The bottle top dispenser as claimed in claim 1, wherein the bottle top dispenser is a burette.

17. The bottle top dispenser as claimed in claim 12, wherein the bottle top dispenser is a burette.

18. The bottle top dispenser as claimed in claim 1, further comprising:

a valve block, and a stop, the stop being positioned to stop movement of the piston downward into contact with the valve block, a gap remaining between the bottom of the piston and the bottom of the cylinder, the stop being at least one of adjustable and removable.

19. The bottle top dispenser according to claim 1, wherein a stroke quotient ratio of a maximum stroke travel of the piston to an effective diameter of the piston is between 1 and 3.

20. The bottle top dispenser as claimed in claim 19, wherein the maximum stroke travel of the piston is about 50 mm, and the stroke quotient for a nominal volume of 25 ml is about 2.0 and for a nominal volume of 50 ml is about 1.4.

21. The bottle top dispenser as claimed in claim 1, wherein the measuring strip is a plastic or ceramic strip, spaced apart portions of which are magnetized by having magnetic powder mixed therein, and wherein the magnetized portions of the measuring strip have a spacing of between 0.3 mm and 2 mm.

22. A bottle top dispenser for handling liquids, comprising:

a piston and cylinder arrangement for the exact take-up and dispensing of liquid volumes, with a cylinder and with a piston running, sealed off, in the cylinder and having a piston rod led upward out of the cylinder, a displacement measuring strip which extends axially in a direction of movement of the piston rod and is fixedly mounted in the dispenser adjacent to the piston rod, and being magnetized, a sensor arrangement sensitive to magnetic fields which is arranged directly on the piston rod or on a component connected to the piston rod in a fixed position relative thereto, the sensor arrangement having a sensor that is aligned with the measuring strip and separated from the measuring strip by only a narrow gap, an indicator for indicating the liquid quantity handled or to be handled, and an electronic evaluation circuit for evaluating analog output signals of the sensor and for activating the indicator, the electronic evaluation circuit being implemented by means of software of a microprocessor or microcomputer, wherein the sensor is a magnetoresistive sensor system, an analog-digital convert for converting the analog sensor signals, and wherein the evaluation circuit has a mixed-signal controller which evaluates the converted analog sensor signals directly via interpolation software.

23. The bottle top dispenser as claimed in claim 22, wherein the magnetoresistive sensor system is adapted to operate based on the AMR-effect.

24. The bottle top dispenser as claimed in claim 22, wherein the mixed-signal controller has a processing stage with processing software and an output stage.

25. The bottle top dispenser as claimed in claim 22, wherein the mixed-signal controller is one of a programmable system on a chip, a digital signal processor and a field programmable gate array with an A/D converter.

26. The bottle top dispenser as claimed in claim 22, wherein the interpolation software is adapted to operate with an ON/OFF duty factor of about 0.1 to about 0.02 with an ON time of about 0.6 ms to about 0.1 ms.

27. The bottle top dispenser as claimed in claim 26, wherein the interpolation software is adapted to operate with an interpolation rate of between 200 and 1000.

28. The bottle top dispenser as claimed in claim 22, wherein the interpolation software is adapted to operate with an interpolation rate of between 200 and 1000.

29. The bottle top dispenser as claimed in claim 22, further comprising an outer housing that is mounted over the piston and cylinder arrangement and is closed at a top side thereof, wherein at least one actuating button capable of being pressed downward for actuation is arranged on the top side of the outer housing, said actuating button being a zero set or resetting button.

30. The bottle top dispenser as claimed in claim 22, further comprising an outer housing that is mounted over the piston and cylinder arrangement and is closed at a top side thereof, wherein the outer housing is provided with ventilation orifices.

31. The bottle top dispenser as claimed in claim 30, wherein to achieve convection, the ventilation orifices are arranged at positions located at least one of centrally and at the bottom and at the top on the outer housing.

32. The bottle top dispenser as claimed in claim 22, further comprising an outer housing that is mounted over the piston and cylinder arrangement and is closed at a top side thereof, wherein the piston rod is located completely inside the outer housing even when the piston is in a highest position thereof in the cylinder.

33. The bottle top dispenser as claimed in claim 22, wherein the sensor arrangement is arranged in a reception pocket that is completely closed with respect to the measuring strip.

34. The bottle top dispenser as claimed in claim 33, wherein the reception pocket is provided with long-hole connections for exact alignment of the reception pocket with respect to the measuring strip.

35. The bottle top dispenser as claimed in claim 33, wherein a side of the sensor arranged facing the measuring strip is behind a thin-layer wall portion of the reception pocket, the wall portion having a thickness of about 0.1 mm to 0.5 mm.

36. The bottle top dispenser as claimed in 22, wherein the measuring strip is positioned in a pocket on the piston rod or a component connected to the piston rod and wherein an axial stop is located on one side in said pocket, said axial stop being the surface facing the piston.

37. The bottle top dispenser as claimed in claim 22, wherein the bottle top dispenser is a burette.

38. The bottle top dispenser as claimed in claim 33, wherein the bottle top dispenser is a burette.

39. The bottle top dispenser as claimed in claim 22, further comprising:

a valve block, and a stop, the stop being positioned to stop movement of the piston downward into contact with the valve block, a gap remaining between the bottom of the piston and the bottom of the cylinder, the stop being at least one of adjustable and removable.

40. The bottle top dispenser according to claim 22, wherein a stroke quotient ratio of a maximum stroke travel of the piston to an effective diameter of the piston is between 1 and 3.

41. The bottle top dispenser as claimed in claim 40, wherein the maximum stroke travel of the piston is about 50 mm, and the stroke quotient for a nominal volume of 25 ml is about 2.0 and for a nominal volume of 50 ml is about 1.4.

42. The bottle top dispenser as claimed in claim 22, wherein the measuring strip is a plastic or ceramic strip, spaced apart portions of which are magnetized by having magnetic powder mixed therein, and wherein the magnetized portions of the measuring strip have a spacing of between 0.3 mm and 2 mm.

* * * * *